US006057815A

United States Patent [19]

Sano

[11] Patent Number: 6,057,815

[45] Date of Patent: May 2, 2000

[54] DRIVER CIRCUIT FOR AC-MEMORY PLASMA DISPLAY PANEL

[75] Inventor: Yoshio Sano, Tokyo, Japan

[73] Assignee: NEC Corporation, Tokyo, Japan

[21] Appl. No.: 08/974,345

[22] Filed: Nov. 19, 1997

[30] Foreign Application Priority Data

Nov. 19, 1996 [JP] Japan ..... 8-307951

[51] Int. Cl.[7] ..... G09G 3/28

[52] U.S. Cl. ..... 345/60; 345/69; 345/68

[58] Field of Search ..... 345/60, 63, 69, 345/80, 91, 55, 76, 87, 68; 315/169.1–169.4

[56] References Cited

U.S. PATENT DOCUMENTS

| | | | |
|---|---|---|---|
| 5,420,602 | 5/1995 | Kanazawa | 345/67 |
| 5,670,974 | 9/1997 | Ohba et al. | 345/60 |
| 5,684,499 | 11/1997 | Shimizu et al. | 345/60 |
| 5,717,437 | 2/1998 | Sano et al. | 345/211 |
| 5,828,353 | 10/1998 | Kishi et al. | 345/55 |

FOREIGN PATENT DOCUMENTS

| | | |
|---|---|---|
| 1-233492 | 9/1989 | Japan . |
| 7-191627 | 7/1995 | Japan . |

OTHER PUBLICATIONS

Akira Otsuka, "Large Size ac–type Color Plasma Display", *Display and Imaging*, vol., 4, 1996, pp. 67–73.

*Primary Examiner*—Lun-Yi Lao
*Assistant Examiner*—Jimmy Hai Nguyen
*Attorney, Agent, or Firm*—Sughrue, Mion, Zinn Macpeak & Seas, PLLC

[57] ABSTRACT

A driver circuit for a plasma display panel has first, second, third, and fourth switches. The first switch is connected to the higher potential side of a sustaining pulse power supply and supplies a current to sustaining electrodes. The second switch is connected to the lower potential side of the sustaining pulse power supply and draws a current from the sustaining electrodes. The third switch is connected to the higher potential side of the sustaining pulse power supply and supplies a current to the scanning electrodes. The fourth switch is connected to the lower potential side of the sustaining pulse power supply and draws a current from the scanning electrodes. Diodes are connected to sustaining electrode blocks for preventing pulses to be generated independently in the sustaining electrode blocks from going around to other sustaining electrode blocks, and diodes are also connected to scanning electrode blocks for preventing pulses to be generated independently in the scanning electrode blocks from going around to other scanning electrode blocks.

4 Claims, 18 Drawing Sheets

DRIVER CIRCUIT FOR AC-MEMORY PLASMA DISPLAY PANEL

BACKGROUND OF THE INVENTION

1. Field of the Invention

The present invention relates to a plasma display panel, and more particularly to a driver circuit for an AC-memory plasma display panel.

2. Description of the Related Art

Plasma display panels are advantageous in that they are simple in structure, can provide wide screen areas, and can use soda glass, which is widely used as window glass, as the material for substrates of plasma display panels.

Plasma display panels comprise two insulating substrates of soda glass, electrodes mounted on the insulating substrates, and partitions mounted on the insulating substrates for defining pixels as display units. The insulating substrates with the electrodes and the partitions disposed thereon are attached to each other, with a discharge gas sealed between the insulating substrates. The partitions are generally of a height of about 0.2 mm, and the insulating substrates each have a thickness of about 3 mm. Therefore, the plasma display panels are very thin and lightweight.

On account of these excellent features, plasma display panels are finding use on personal computers and office workstations, which have made much progress in recent years, and also will be used on large-screen wall-hanging television sets, which are expected to be become popular in the future.

The plasma displays are roughly classified into DC-type plasma displays and AC-type plasma displays. In the DC-type plasma displays, electrodes are held in direct contact with a discharge gas, and a direct current flows through the electrodes once a discharge occurs in the discharge gas. The AC-type plasma displays have an insulating layer interposed between electrodes and a discharge gas. After a voltage is applied, a current flows as a pulse for a short period of time such as about 1 microsecond and then converges. Since the insulating layer operates as a capacitor, when AC pulses are applied, pulsed emissions are repeatedly generated to display images.

While DC-type plasma displays are simpler in structure, electrodes are consumed quickly because they are exposed directly to discharges, making the DC-type plasma displays has a short service life. On the other hand, AC-type plasma displays have a longer service life because the electrodes are covered with the insulating layer though it entails an expenditure of labor and cost to form the insulating layer. Recent years have seen efforts to develop AC-type plasma displays for the reason that it is now possible to easily realize a function called a memory to achieve high-luminance light emissions.

The structure of an AC-memory plasma display panel and a method of driving the AC-memory plasma display panel, and a conventional driver circuit will be described below.

FIGS. 1A and 1B of the accompanying drawings show a general AC-memory plasma display panel disclosed in Japanese laid-open patent publication No. 295506/95. The disclosed AC-memory plasma display panel can be energized by a driver circuit according to the present invention and a conventional driver circuit. As shown in FIGS. 1A and 1B, the general AC-memory plasma display panel comprises a first insulating substrate 11 of soda glass having a thickness of 3 mm, a second insulating substrate 12 of soda glass having a thickness of 3 mm, striped sustaining electrodes 13*a* of transparent nesa film, striped scanning electrodes 13*b* of transparent nesa film, metal electrodes 13*c* of thick silver film for supplying sufficient currents to the transparent sustaining electrodes 13*a* and the scanning electrodes 13*b*, striped column electrodes 14 of thick silver film, a discharge gas space 15 filled with a discharge gas of He and Ne composed at a ratio of 7:3, respectively, with 3% of Xe mixed under a total pressure of 500 Torr, partitions 16 of thick film which sustains the discharge gas space 15 and defining pixels, a fluorescent layer 17 of $Zn_2SiO_4$: Mn for converting ultraviolet radiation generated by a discharge in the discharge gas into visible light, an insulating layer 18a of transparent thick-film glaze covering the sustaining electrodes 13*a*, the scanning electrodes 13*b*, and the metal electrodes 13*c*, an insulating layer 18*b* of thick film covering the column electrodes 14, and a protective layer 19 of MgO having a thickness of 2 um for protecting the insulating layer 18*b* from discharges.

In FIG. 1A, regions surrounded by the partitions 16 which extend vertically and horizontally serve as pixels 20. A pixel at the point of intersection between a scanning electrode Si (i=1, 2, . . . , m) and a column electrode Dj (j=1, 2, . . . , n) is represented by $a_{ij}$. With the fluorescent layer 17 being coated with colors of red, green, and blue in alignment with the respective pixels, the AC-memory plasma display panel serves as a plasma display panel capable of displaying images in full colors.

The AC-memory plasma display panel may display images on an upper surface or a lower surface thereof as viewed in FIG. 1B. In the structure shown in FIGS. 1A and 1B, the lower surface of the AC-memory plasma display panel has a greater aperture ratio, and should preferably be used as a display surface because it allows a viewer to directly see light-emitting regions of the fluorescent layer 17 and provide a higher level of luminance.

FIG. 2 of the accompanying drawings shows in plan a plasma display panel with electrodes being illustrated with greater emphasis. The plasma display panel, denoted at 10, has a first insulating substrate 11 and a second insulating substrate 12 which are attached to each other and hermetically sealed by a seal 21 with a discharge gas filled between the first and second insulating substrates 11, 12. The plasma display panel 10 also has an array 13*a* of sustaining electrodes C1, C2, . . . , Cm, an array 13*b* of scanning electrodes S1, S2, . . . , Sm, and an array 14 of column electrodes D1, D2, . . . , Dn−1, Dn.

In an actual plasma display panel design, there are 480 scanning electrodes $S_1$, $S_2$, . . . , Sm, 480 sustaining electrodes $C_1$, $C_2$, . . . , $C_m$, and 1920 column electrodes $D_1$, $D_2$, . . . , $D_{n-1}$, $D_n$. Pixels are spaced at a pitch of 0.35 mm between the column electrodes and a pitch of 1.05 mm between the scanning electrodes. The distance between adjacent scanning and column electrodes is 0.2 mm.

A process of displaying gradations on the plasma display panel will be described below. Unlike other display desices, since it is difficult for the plasma display panel to display highly luminous gradations by varying applied voltages, it is customary for the plasma display panel to display highly luminous gradations by controlling the number of times that it produces light emissions. For displaying highly luminous gradations, the plasma display panel is controlled by a subfield process described below.

FIG. 3 of the accompanying drawings illustrates a graph having a horizontal axis which represents time and a vertical axis which represents scanning electrodes. One image is transmitted in one field by a computer or a broadcasting system. While the time of a field differs depending on the computer or the broadcasting system, it is usually set to a range from about 1/50 to 1/75 second.

For a plasma display panel to display gradations, one field is divided into k subfields (k=6 subfields SF1~SF6 in FIG. 3). Each of the subfields has a sustaining discharge period for display light emissions and a writing discharge control period which includes periods for preliminary discharge other than sustaining discharge, preliminary discharge extinguishment, and scanning.

The number of light emissions caused by sustaining discharges for each pixel in the subfields SF1~SF6 is weighted by $2^n$, and the luminance of a displayed image is controlled as follows:

$$\text{Luminance} = \sum_{n=1}^{k} (L_1 \times 2^{n-1}) \times a_n$$

where n is the number of a subfield, with the subfield of lowest luminance being numbered "1" and the subfield of highest luminance being numbered "k", $L_1$ is the luminance of the subfield of lowest luminance, and $a_n$ is a variable which takes a value of 1 or 0, $a_n$=1 if light is to be emitted from the pixel in the nth subfield and $a_n$=0 if light is not to be emitted from the pixel in the nth subfield. Since the subfields have different levels of luminance of emitted light, the luminance can be controlled by selecting energization or de-energization of each of the subfields.

In FIG. 3, k=6, and if color pixels of red, green, and blue are combined into one pixel set for displaying color images, then it is possible to express $2^k=2^6=64$ gradations for each of the colors, and to display $64^3=262144$ colors (including black). If k=1, then one field is equal to one subfield, and it is possible to express 2 gradations (on or off) for each of the colors, and to display $2^3=8$ colors (including black).

FIG. 4 of the accompanying drawings shows the waveforms of drive voltages and emitted light in one subfield of the plasma display panel shown in FIGS. 1A, 1B and 2.

In FIG. 4, a waveform A represents a voltage applied to the sustaining electrodes $C_1, C_2, \ldots, Cm$, a waveform B a voltage applied to the scanning electrode $S_1$, a waveform C a voltage applied to the scanning electrode $S_2$, a waveform D a voltage applied to the scanning electrode $S_m$, a waveform E a voltage applied to the column electrode $D_1$, a waveform F a voltage applied to the column electrode $D_2$, and a waveform G light emitted from a pixel $a_{11}$. Pulses with diagonal lines of the waveforms E, F indicate that their presence or absence is determined by the presence or absence of data to be written. In FIG. 4, data voltage waveforms show that data are written in pixels $a_{11}$, $a_{22}$, and pixels of the third and following rows display images depending on the presence or absence of data.

Sustaining pulses 31 and a preliminary discharge pulse 36 are applied to the sustaining electrodes $C_1, C_2, \ldots, C_m$. Sustaining pulses 32, extinguishing pulses 35, and preliminary discharge extinguishing pulses 37, which are common to the scanning electrodes $S_1, S_2, \ldots, Sm$, and scanning pulses 33 at times independent of the scanning electrodes $S_1, S_2, \ldots, S_m$, are applied linearly sequentially to the scanning electrodes $S_1, S_2, \ldots, S_m$. If there is light emission data, then data pulses are applied to the column electrodes $D_j$ (j=1, 2, . . . , n) in synchronism with the scanning pulses 33.

The plasma display panel shown in FIGS. 1A, 1B, and 2 operates as follows: Those pixels which have emitted light in the preceding subfield are extinguished by the extinguishing pulses 35. Then, all the pixels are forcibly discharged once by the preliminary discharge pulse 36, and the preliminary discharge is extinguished by the preliminary discharge extinguishing pulses 37, allowing writing discharges to occur easily with next scanning pulses 33.

After the preliminary discharge is extinguished, the scanning pulses 33 and the data pulses 34 are synchronously applied between the scanning electrodes and the column electrodes for causing writing discharges. Subsequently, sustaining discharges are sustained between adjacent sustaining and scanning electrodes by the sustaining pulses 31, 32. When only the scanning pulses 33 or the data pulses 34 are applied, no writing discharges occur, and no subsequent sustaining discharges occur. Such a function is referred to as a memory function. The luminance of light emitted in each of the subfields is controlled by the number of sustaining discharges.

FIG. 5 of the accompanying drawings shows a different process of driving a plasma display panel as disclosed in Japanese laid-open patent publication No. 42289/92. In FIG. 5, $T_1$~$T_6$ represent subfields. According to the process shown in FIG. 5, the timing of writing discharges and the timing of sustaining discharges are scanned, and one preliminary discharge occurs per field. FIG. 6 of the accompanying drawings shows the waveforms of drive voltages applied in one subfield shown in FIG. 5. As shown in FIG. 6, sustaining pulses are successively applied unlike the waveforms shown in FIG. 4. Three scanning pulses are applied in one sustaining pulse period, and data pulses are applied synchronously with the scanning pulses in a manner not to overlap the sustaining pulses and extinguishing pulses. In association with scanning pulses, extinguishing pulses are applied simultaneously to three scanning electrodes, and are scanned as one set.

Finally, a circuit for generating these waveforms of drive voltages will be described below. As can be seen from FIG. 4, the sustaining pulses 31, 32 are applied commonly to the sustaining electrodes $C_1, C_2, \ldots, C_m$ and the scanning electrodes $S_1, S_2, \ldots, S_m$. Therefore, a circuit for generating sustaining pulses may be shared throughout the entire screen of the plasma display panel. For example, as shown in FIG. 3 of an article "Large-screen AC color plasma display—View in present and future—", written by Akira Ohtsuka (a magazine "Display and Imaging (Japanese version)", 1996, Vol. 4, pages 67~73, published by Science Communications International Co., Ltd.), a circuit for generating sustaining pulses 31 for sustaining electrodes is marked with "X SUSTAIN PULSER", and generated sustaining pulses are applied altogether to the entire screen. In addition, a circuit for generating sustaining pulses 32 for scanning electrodes is marked with "Y SUSTAIN PULSER", and generated sustaining pulses are also applied altogether to the entire screen.

It is known that in order to cause writing discharges reliably, the time after preliminary discharge extinguishing pulses 37 are applied until scanning pulses 33 are applied should be as short as possible. It is also known that in order to cause sustaining discharges reliably after writing discharges, the time from the writing discharges until sustaining discharges should be as short as possible. See Japanese laid-open patent publication No. 191627/95 for details.

FIG. 7 of the accompanying drawings shows a driving process of a first technical example shown in FIG. 1 of Japanese laid-open patent publication No. 191627/95, the view illustrating a driven state of one subfield. In FIG. 7, A1 represents a period for applying preliminary discharge pulses, B1 a period for applying preliminary discharge extinguishing pulses, $C_{11}$, $C_{12}$, $C_{13}$ writing discharge periods, $E_{11}$, $E_{12}$, $E_{13}$ first sustaining discharge periods, and $D_1$ a second sustaining discharge period.

Scanning electrodes $S_1, S_2, \ldots, S_m$ are divided into three scanning electrode blocks G, H, I. Although not shown, sustaining electrodes $C_1$~$C_m$ paired with the scanning electrodes $S_1$~$S_m$ are also grouped into three sustaining electrode blocks corresponding to the scanning electrode blocks G, H, I.

In FIG. 7, in order to reduce the period from writing discharges until sustaining discharges, independent sustaining discharge periods E11, E12, E13 are provided for the respective scanning electrode blocks or the respective sustaining electrode blocks immediately after writing processes in the respective scanning electrode blocks are finished.

FIG. 8 of the accompanying drawings shows the waveforms of drive voltages (FIG. 3 of Japanese laid-open patent publication No. 191627/95) according to the driving process shown in FIG. 7. In FIG. 8, A7 represents a period for applying preliminary discharge pulses, B7 a period for applying preliminary discharge extinguishing pulses, C71, C72, C73 writing discharge periods, E71, E72, E73 first sustaining discharge periods, and D7 a second sustaining discharge period.

In FIG. 8, COM1, COM2, COM3 represent the waveforms of sustaining electrode drive voltages applied to the respective sustaining electrode blocks, S11, S12 the waveforms of drive voltages applied to first and second scanning electrodes of the scanning electrode block G, S21, 522 the waveforms of drive voltages applied to first and second scanning electrodes of the scanning electrode block H, S31, S32 the waveforms of drive voltages applied to first and second scanning electrodes of the scanning electrode block I, and DATA the waveform of a drive voltage applied to a data electrode.

As can be understood from FIG. 8, since the first sustaining discharge periods E71, E72, E73 are independent with respect to the scanning electrode blocks and the sustaining electrode blocks, sustaining pulses 41 contained in the waveforms COM1, COM2, COM3 of sustaining electrode drive voltages are independent with respect to the sustaining electrode blocks. Similarly, sustaining pulses 42 contained in the wave-forms S11, S12, S21, S22, S31, S32 of scanning electrode drive voltages of the scanning electrode blocks are independent with respect to the scanning electrode blocks.

For causing writing discharges reliably and making a reliable shift from writing discharges to sustaining discharges, the driving process which employs the scanning electrode blocks and the sustaining electrode blocks may be employed as described above. Since sustaining pulses used in the scanning electrode blocks and the sustaining electrode blocks need to be independently controlled, circuits for generating sustaining pulses for the sustaining electrodes of the sustaining electrode blocks and the scanning electrodes of the scanning electrode blocks are provided independently in association with the sustaining electrode blocks and the scanning electrode blocks, respectively. A circuit arrangement including those circuits is illustrated in FIG. 9 of the accompanying drawings.

The circuit arrangement shown in FIG. 9 includes scanning pulse generators 2 for generating scanning pulses 33, data pulse generators 4 for generating data pulses, sustaining-electrode common pulse generators 39 for generating preliminary discharge extinguishing pulses 37 and sustaining pulses 41 and sustaining pulses 31 independent with respect to the sustaining electrode blocks, and scanning-electrode common pulse generators 40 for generating preliminary discharge pulses 36 and sustaining pulses 42 and sustaining pulses 32 independent with respect to the scanning electrode blocks. Sustaining electrodes 13*a* are divided into three sustaining electrode blocks CC11~CC1m, CC21~CC2m, CC31~CC3m corresponding to the scanning electrode blocks, and are connected commonly to electrodes CA, CB, CC for the respective sustaining electrode blocks.

As revealed in Japanese laid-open patent publication No. 191627/95, the driving process which employs the scanning electrode blocks and the sustaining electrode blocks may be employed for causing writing discharges reliably and making a reliable shift from writing discharges to sustaining discharges to eliminate writing errors.

As sustaining pulses used in the scanning electrode blocks and the sustaining electrode blocks need to be independently controlled, circuits for generating sustaining pulses for the sustaining electrodes of the sustaining electrode blocks and the scanning electrodes of the scanning electrode blocks are provided independently in association with the sustaining electrode blocks and the scanning electrode blocks, respectively.

To actually carry out the driving process which employs the scanning electrode blocks and the sustaining electrode blocks, the plasma display panel is energized with the independent circuits for generating sustaining pulses for the sustaining electrodes of the sustaining electrode blocks and the scanning electrodes of the scanning electrode blocks. Because the sustaining pulse generating circuits are provided independently in association with the sustaining electrode blocks and the scanning electrode blocks, respectively, if the numbers of pixels that emit light in the sustaining electrode blocks and the scanning electrode blocks differ from each other, then the sustaining electrode blocks and the scanning electrode blocks emit light with different luminances. Reasons why such luminance differences are produced by the sustaining electrode blocks or the scanning electrode blocks will be described below.

FIG. 10 of the accompanying drawings shows a basic sustaining pulse generating circuit for use as the sustaining-electrode common pulse generators 39 or the scanning-electrode common pulse generators 40 in the circuit arrangement illustrated in FIG. 9. As shown in FIG. 10, the basic sustaining pulse generating circuit comprises a P-channel FET 51 serving as a pull-up switch, an N-channel FET 52 serving as a pull-down switch, an electrolytic capacitor 53, and a small-capacitance capacitor 54 which comprises a ceramic capacitor or a film capacitor. The basic sustaining pulse generating circuit also has voltage measuring points PP1, PP2 and a power supply terminal—VS for applying a sustaining voltage—VS.

In FIG. 10, the electrolytic capacitor 53 has a static capacitance of 10 uF or higher. Since the plasma display panel has a static capacitance of about 10 nF, the static capacitance of the electrolytic capacitor 53 is at least 1000 times the static capacitance of the plasma display panel. High-frequency components having frequencies of at least 100 KHz bypass the electrolytic capacitor 53 through the small-capacitance capacitor 54. Therefore, when light-emitting currents are supplied to the plasma display panel, any potential fluctuations at the voltage measuring point PP1 are small.

The N-channel FET 52 has an on-state resistance of about 0.5 Ω with respect to a peak current of about 20 A, thus producing a voltage drop of about 10 V. If economy were ignored, then it would be possible to use a switching device such as an FET having a larger current capacity and a smaller on-state current. However, in view of cost and size considerations, it is necessary to use FETs of such an on-state resistance.

As described above, a voltage drop in circuits for generating sustaining pulses when discharge light emissions are produced is mainly developed by switches such as FETS.

FIG. 11A of the accompanying drawings shows the waveforms of voltages in the sustaining pulse generating circuit shown in FIG. 10 for the scanning electrode blocks and the sustaining electrode blocks where the number of light-emitting pixels is small, and FIG. 11B of the accompanying drawings shows the waveforms of voltages in the sustaining pulse generating circuit shown in FIG. 10 for the scanning electrode blocks and the sustaining electrode blocks where the number of light-emitting pixels is large. In FIGS. 11A and 11B, the reference numeral "60" represents a sustaining pulse and the reference numerals "61"~"64", voltage reductions at the time of a discharge light emission.

When the number of light-emitting pixels is small, as shown in FIG. 11A, the voltage drop across the N-channel FET 52 is small, and the voltage reduction 62 caused at the voltage measuring point PP2 by a voltage drop due to a discharge light emission is also small. However, when the number of light-emitting pixels is large, as shown in FIG. 11B, while any potential fluctuations at the voltage measuring point PP1 are small, the voltage drop across the N-channel FET 52 is large, and the voltage reduction 62 caused at the voltage measuring point PP2 by a voltage drop due to a discharge light emission is of a large value of at least 10 V.

Therefore, the luminance of light emissions from the scanning electrode blocks and the sustaining electrode blocks where the number of light-emitting pixels is small is high because the voltage reduction 62 is small and a sufficient voltage is applied to the light-emitting pixels, whereas the luminance of light emissions from the scanning electrode blocks and the sustaining electrode blocks where the number of light-emitting pixels is large is low because the voltage reduction 64 is large and a sufficient voltage is not applied to the light-emitting pixels.

Such a phenomenon may be minimized by reducing the internal resistance of the circuits for generating sustaining pulses to a sufficiently low level. Specifically, the internal resistance of switching elements such as power FETs that develop a large voltage drop in the circuits for generating sustaining pulses may be reduced to a sufficiently low level. If the internal resistance of such switching elements is reduced to a sufficiently low level, however, the switching elements have to be greatly increased in size. As a result, not only the sustaining pulse generating circuits are greatly increased in size, but also the switching elements and driver circuits for driving the switching elements are also greatly increased in cost to the point where these switching elements and circuits are not practically affordable.

According to the conventional technical achievements limited by physical sizes and economical limitations, therefore, the scanning electrode blocks and the sustaining electrode blocks which have different numbers of light-emitting pixels have suffered different levels of luminance.

If the scanning electrode blocks and the sustaining electrode blocks have different levels of luminance, then luminance differences can clearly be perceived between the scanning electrode blocks or the sustaining electrode blocks. Such luminance differences can immediately be recognized by not only persons who are deeply involved in image display fields but also general people who watch display devices. The luminance differences between the scanning electrode blocks or the sustaining electrode blocks are not contained in original images to be displayed, and hence make displayed images false. The luminance differences are conspicuous particularly in the display of scenic images, and tend to completely impair the displayed quality of scenic images. Such a shortcoming is fatal for display units, and so crucial that it will spoil the commercial value of display units.

SUMMARY OF THE INVENTION

It is therefore an object of the present invention to provide a driver circuit for a plasma display panel, which can cause writing discharges reliably and make a reliable shift from writing discharges to sustaining discharges, thereby eliminating writing errors of the plasma display panel, and which will remove luminance fluctuations of scanning electrode blocks or sustaining electrode blocks while maintaining conventional circuit size and cost levels, in connection with a process of driving electrodes in such scanning electrode blocks and sustaining electrode blocks.

According to the present invention, there is provided a driver circuit for a plasma display panel having striped scanning electrodes and striped column electrodes perpendicular to the striped scanning electrodes, the scanning electrodes being divided into a plurality of scanning electrode blocks, and also having a preliminary discharge period and a writing period for each of the scanning electrode blocks, and a sustaining period common to all of the scanning electrodes.

The driver circuit includes a data pulse generator for generating data pulses, a plurality of scanning pulse generators associated with the scanning electrode blocks, respectively, for generating scanning pulses, a first switch comprising a pull-up switch for generating sustaining pulses to be applied to the plasma display panel in the sustaining period, the first switch having an end connected to a higher potential side of a sustaining pulse power supply and an opposite end for supplying a current to the plasma display panel, and a first group of as many diodes as the number of the scanning electrode blocks, the diodes of the first group having respective anodes connected in common to the opposite end of the first switch and respective cathodes connected respectively to the scanning pulse generators. The driver circuit also includes a second switch comprising a pull-down switch for generating sustaining pulses to be applied to the plasma display panel in the sustaining period, the second switch having an end connected to a lower potential side of the sustaining pulse power supply and an opposite end for drawing a current from the plasma display panel, and a second group of as many diodes as the number of the scanning electrode blocks, the diodes of the second group having respective cathodes connected in common to the opposite end of the second switch and respective anodes connected respectively to the scanning pulse generators.

The driver circuit further includes third switches associated respectively with the scanning electrode blocks for generating pulses other than the sustaining pulses independently with respect to the scanning electrode blocks.

According to the present invention, there is also provided a driver circuit for a plasma display panel having striped scanning electrodes, striped sustaining electrodes paired with the scanning electrodes and extending parallel to the scanning electrodes, striped column electrodes perpendicular to the scanning electrodes and the sustaining electrodes, the scanning electrodes being divided into a plurality of scanning electrode blocks and the sustaining electrodes being divided into a plurality of sustaining electrode blocks paired with the scanning electrode blocks, and also having a preliminary discharge period and a writing period for each of the scanning electrode blocks and the sustaining electrode blocks, and a sustaining period common to all of the scanning electrodes and the sustaining electrodes.

The driver circuit includes a data pulse generator for generating data pulses, a plurality of scanning pulse generators associated with the scanning electrode blocks, respectively, for generating scanning pulses, a first switch comprising a pull-up switch for generating sustaining pulses with respect to the scanning electrodes to be applied to the plasma display panel in the sustaining period, the first switch having an end connected to a higher potential side of a sustaining pulse power supply and an opposite end for supplying a current to the plasma display panel, and a first group of as many diodes as the number of the scanning electrode blocks, the diodes of the first group having respective anodes connected in common to the opposite end of the first switch and respective cathodes connected respectively to the scanning pulse generators. The driver circuit also includes a second switch comprising a pull-down switch for generating sustaining pulses with respect to the scanning electrodes to be applied to the plasma display panel in the sustaining period, the second switch having an end connected to a lower potential side of the sustaining pulse power supply and an opposite end for drawing a current from the plasma display panel, and a second group of as many diodes as the number of the scanning electrode blocks, the diodes of the second group having respective cathodes connected in common to the opposite end of the second switch and respective anodes connected respectively to the scanning pulse generators. The driver circuit further includes a third switch comprising a pull-up switch for generating sustaining pulses with respect to the sustaining electrodes to be applied to the plasma display panel in the sustaining period, the third switch having an end connected to the higher potential side of the sustaining pulse power supply and an opposite end for supplying a current to the plasma display panel, and a third group of as many diodes as the number of the sustaining electrode blocks, the diodes of the third group having respective anodes connected in common to the opposite end of the third switch and respective cathodes connected respectively to the sustaining electrode blocks. The driver circuit also includes a fourth switch comprising a pull-down switch for generating sustaining pulses with respect to the sustaining electrodes to be applied to the plasma display panel in the sustaining period, the fourth switch having an end connected to the lower potential side of the sustaining pulse power supply and an opposite end for drawing a current from the plasma display panel, and a fourth group of as many diodes as the number of the sustaining electrode blocks, the diodes of the fourth group having respective cathodes connected in common to the opposite end of the fourth switch and respective anodes connected respectively to the sustaining electrode blocks.

The driver circuit also includes fifth switches associated respectively with the scanning electrode blocks for generating pulses other than the sustaining pulses independently with respect to the scanning electrode blocks, and sixth switches associated respectively with the sustaining electrodes for generating pulses other than the sustaining pulses independently with respect to the sustaining electrode blocks.

With the above circuit arrangement, it is possible to completely eliminate luminance differences between the scanning electrode blocks or the sustaining electrode blocks. Specifically, switches for generating sustaining pulses, which have heretofore been provided independently with respect to the scanning electrode blocks and the sustaining electrode blocks, are used commonly over the entire screen of the plasma display panel. Therefore, even if the resistance of the switches for generating sustaining pulses is somewhat large, the waveforms of sustaining pulse voltages applied to any blocks are the same as each other. Consequently, luminance irregularities between the blocks are eliminated even if the switches for generating sustaining pulses do not comprise expensive components of low resistance.

The driver circuit according to the present invention is effective in completely eliminating luminance irregularities because the waveforms of sustaining pulse voltages applied to the blocks are made equal to each other in principle.

However, if the blocks were simply electrically connected to each other for sharing sustaining pulses, then it would not be possible to generate pulses to be applied independently to the scanning electrode blocks or the sustaining electrode blocks. Therefore, output signals from the common sustaining pulse generating switches are divided into independent pull-up and pull-down switch signals, which are then supplied through the diodes to the scanning electrode blocks or the sustaining electrode blocks.

The circuit arrangement which includes the diodes is relatively simple and can supply common sustaining pulses to the entire screen of the plasma display panel for thereby causing writing discharges reliably, making a reliable shift from writing discharges to sustaining discharges, and also eliminating writing errors of the plasma display panel. When a driving process employing the scanning electrode blocks and the sustaining electrode blocks is relied upon, luminance differences that have heretofore been developed in the scanning electrode blocks and the sustaining electrode blocks can completely be eliminated. Since only additional parts that are needed are two inexpensive diodes per scanning electrode block or sustaining electrode block, the driver circuit according to the present invention does not incur any substantial cost increase, but is nevertheless highly effective.

The above and other objects, features, and advantages of the present invention will become apparent from the following description with reference to the accompanying drawings which illustrate examples of the present invention.

DETAILED DESCRIPTION OF THE PREFERRED EMBODIMENTS

Figure 12:
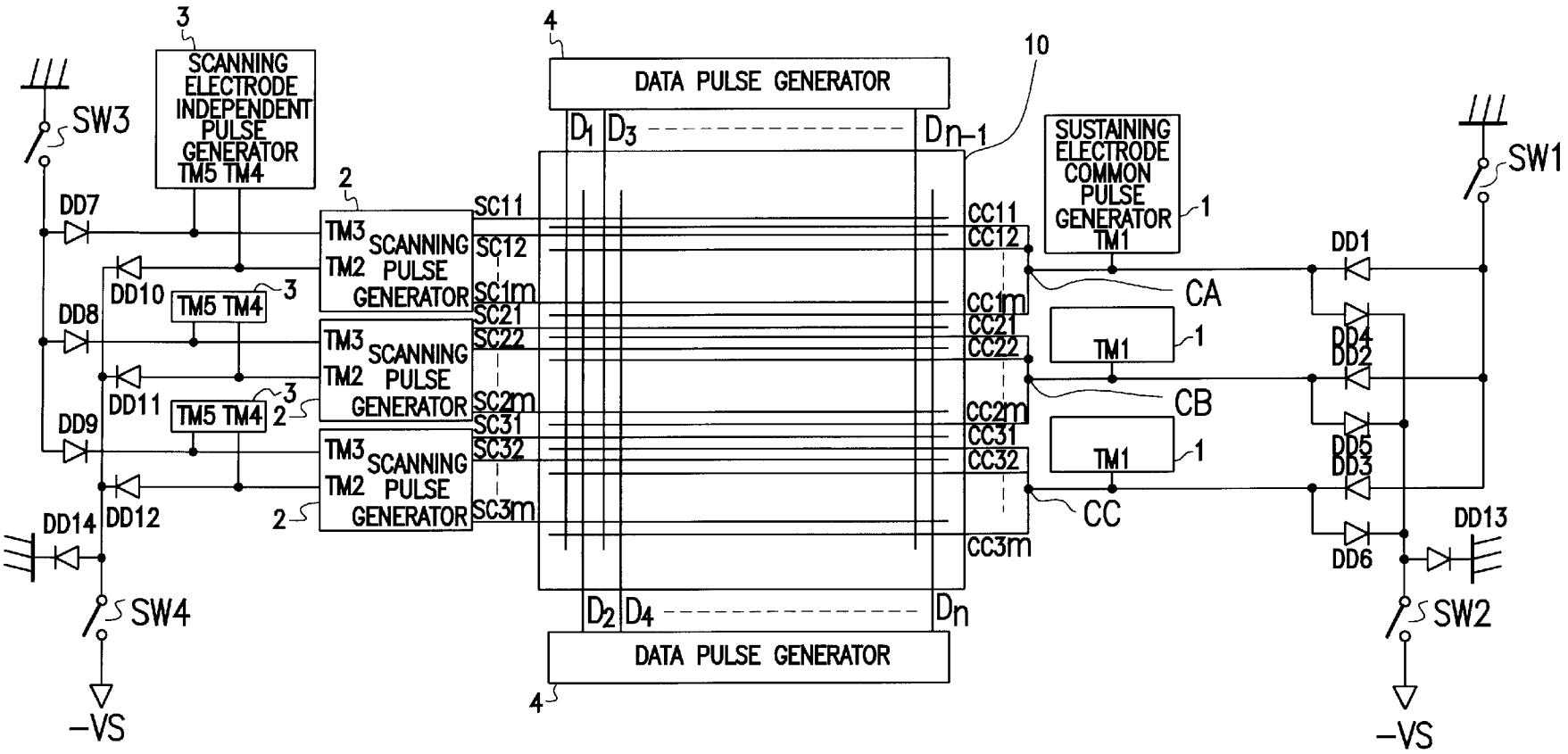
FIG. 12 is a block diagram of a driver circuit for a plasma display panel according to a first embodiment of the present invention.

As shown in FIG. 12, a driver circuit for a plasma display panel 10 according to a first embodiment of the present invention comprises sustaining-electrode independent pulse generators 1 for generating preliminary discharge pulses 36 (see FIG. 15) and independent sustaining pulses 41 (see FIG. 15) for sustaining electrode blocks, scanning pulse generators 2 for generating scanning pulses 33 (see FIG. 15), scanning-electrode independent pulse generators 3 for supplying DC scanning voltages to the scanning pulse generators 2 during writing discharge periods, data pulse generators 4, diodes DD1~DD14, and switches SW1~SW4 for generating common sustaining pulses over the entire screen of the plasma display panel 10.

The switch SW1 comprises a pull-up switch which is connected to a higher potential side (ground level in FIG. 12) of a sustaining pulse power supply for supplying a sustaining pulse current to sustaining electrodes. The switch SW2 comprises a pull-down switch which is connected to a lower potential side (power supply terminal—VS in FIG. 12) of the sustaining pulse power supply for drawing the sustaining pulse current from the sustaining electrodes. The switch SW3 comprises a pull-up switch which is connected to the higher potential side (ground level in FIG. 12) of the sustaining pulse power supply for supplying a sustaining pulse current to scanning electrodes. The switch SW4 comprises a pull-down switch which is connected to the lower potential side (power supply terminal—VS in FIG. 12) of the sustaining pulse power supply for drawing the sustaining pulse current from the scanning electrodes.

The scanning electrodes are divided into three scanning electrode blocks SC11~SC1m, SC21~SC2m, SC31~SC3m, and the sustaining electrodes are also divided into three sustaining electrode blocks CC11~CC1m, CC21~CC2m, CC31~CC3m paired with the scanning electrode blocks SC11~SC1m, SC21~SC2m, SC31~SC3m and connected commonly to respective electrodes CA, CB, CC.

As shown in FIG. 12, the sustaining pulse generating switches, which have heretofore been provided respectively for the scanning electrode blocks and the sustaining electrode blocks, are provided as common switches shared by the scanning electrode blocks and the sustaining electrode blocks. Diodes DD1~DD6 are connected to the sustaining electrode blocks for preventing pulses generated independently by each of the sustaining electrode blocks from going around to the other sustaining electrode blocks. Similarly, diodes DD7~DD12 are connected to the scanning electrode blocks for preventing pulses generated independently by each of the scanning electrode blocks from going around to the other scanning electrode blocks.

The circuit arrangement which includes the diodes D1~D12 is relatively simple and can supply common sustaining pulses to the entire screen of the plasma display panel 10 for thereby completely eliminating luminance irregularities that have heretofore been developed in the scanning electrode blocks or the sustaining electrode blocks.

Figure 13A:
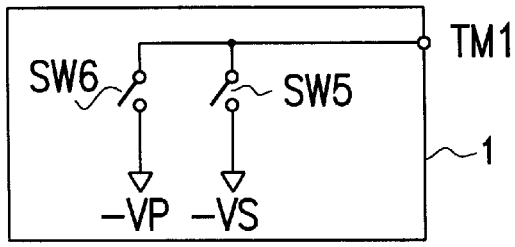
FIGS. 13A, 13B, and 13C are circuit diagrams of various pulse generators of the driver circuit shown in FIG. 12.
Figure 13B:
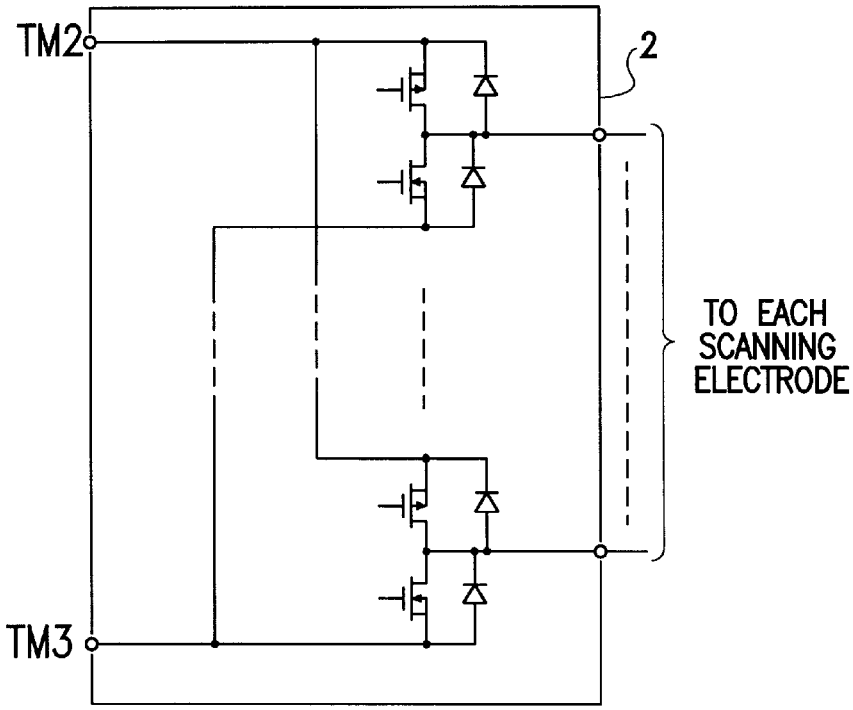
Figure 13C:
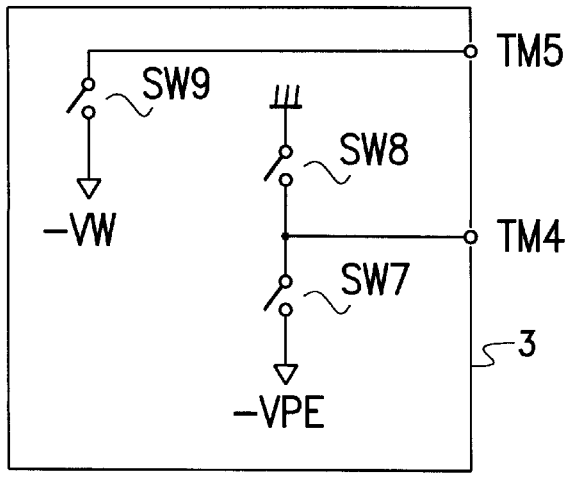

FIGS. 13A, 13B, and 13C show each of the sustaining-electrode independent pulse generators 1, each of the scanning pulse generators 2, and each of the scanning-electrode independent pulse generators 3, respectively, of the driver circuit shown in FIG. 12. As shown in FIG. 13A, the each of the sustaining-electrode independent pulse generators 1 comprises a switch SW5 connected between a terminal TM1 and the power supply terminal—VS, and a switch SW6 connected between the terminal TM1 and a power supply terminal—VP which applies a preliminary discharge voltage. As shown in FIG. 13B, each of the scanning pulse generators 2 comprises series-connected FETs shunted by respective diodes and connected between terminals TM2, TM3. As shown in FIG. 13C, each of the scanning-electrode independent pulse generators 3 comprises a switch SW7 connected between a terminal TM4 and a power supply terminal—VPE which applies a preliminary discharge extinguishing voltage, a switch SW8 connected between ground and the terminal TM4, and a switch SW9 connected between a terminal TM5 and a power supply terminal—VW which applies a scanning voltage.

Figure 1A:
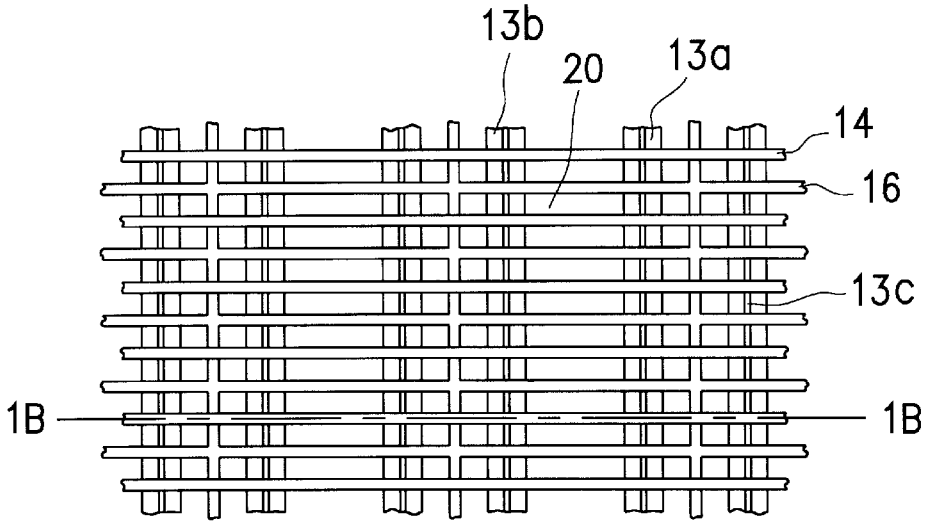
FIG. 1A PRIOR ART
FIG. 1A is a fragmentary plan view of a conventional plasma display panel.
Figure 1B:
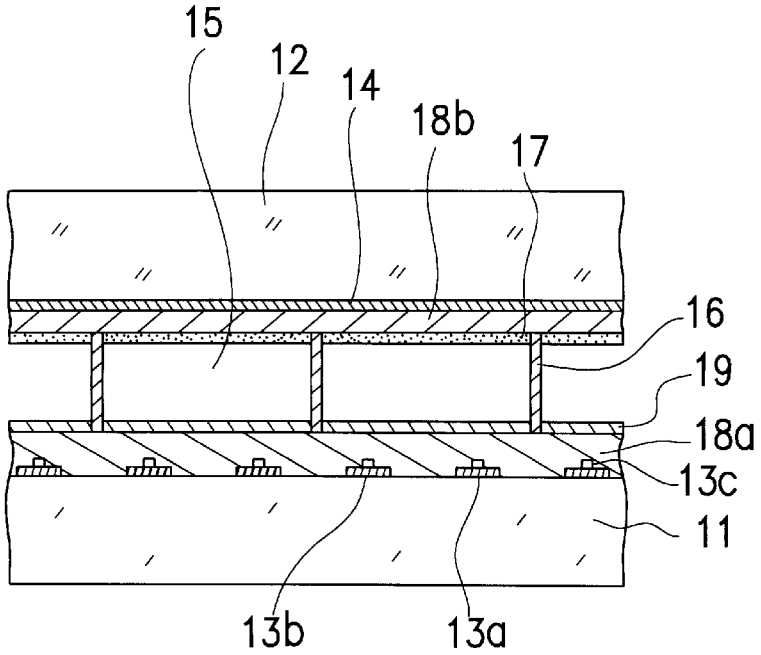
FIG. 1B PRIOR ART
FIG. 1B is a cross-sectional view taken along line 1B—1B of FIG. 1A.
Figure 2:
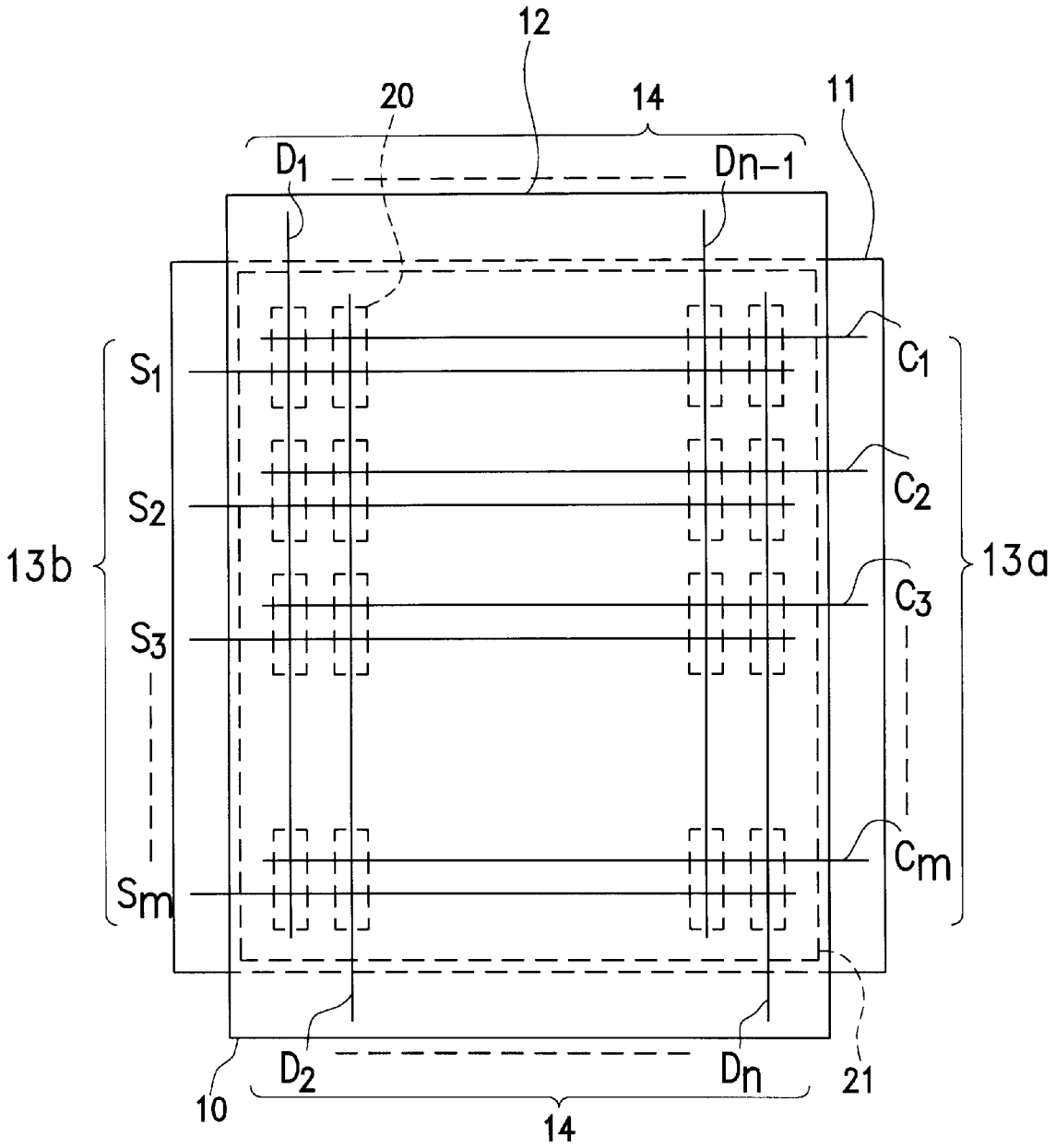
FIG. 2 PRIOR ART
FIG. 2 is a diagram of the plasma display panel shown in FIG. 1A with electrodes being illustrated with greater emphasis.
Figure 3:
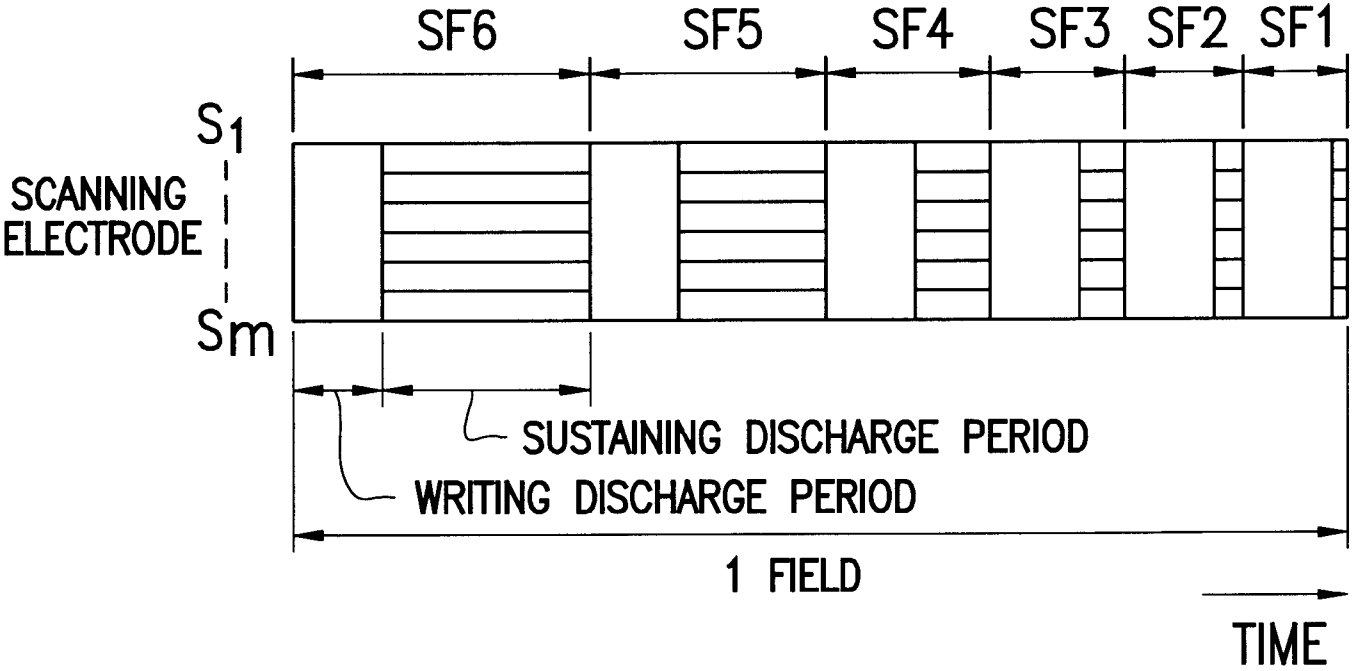
FIG. 3 is a diagram illustrating subfields with separate scanning and sustaining discharges.
Figure 4:
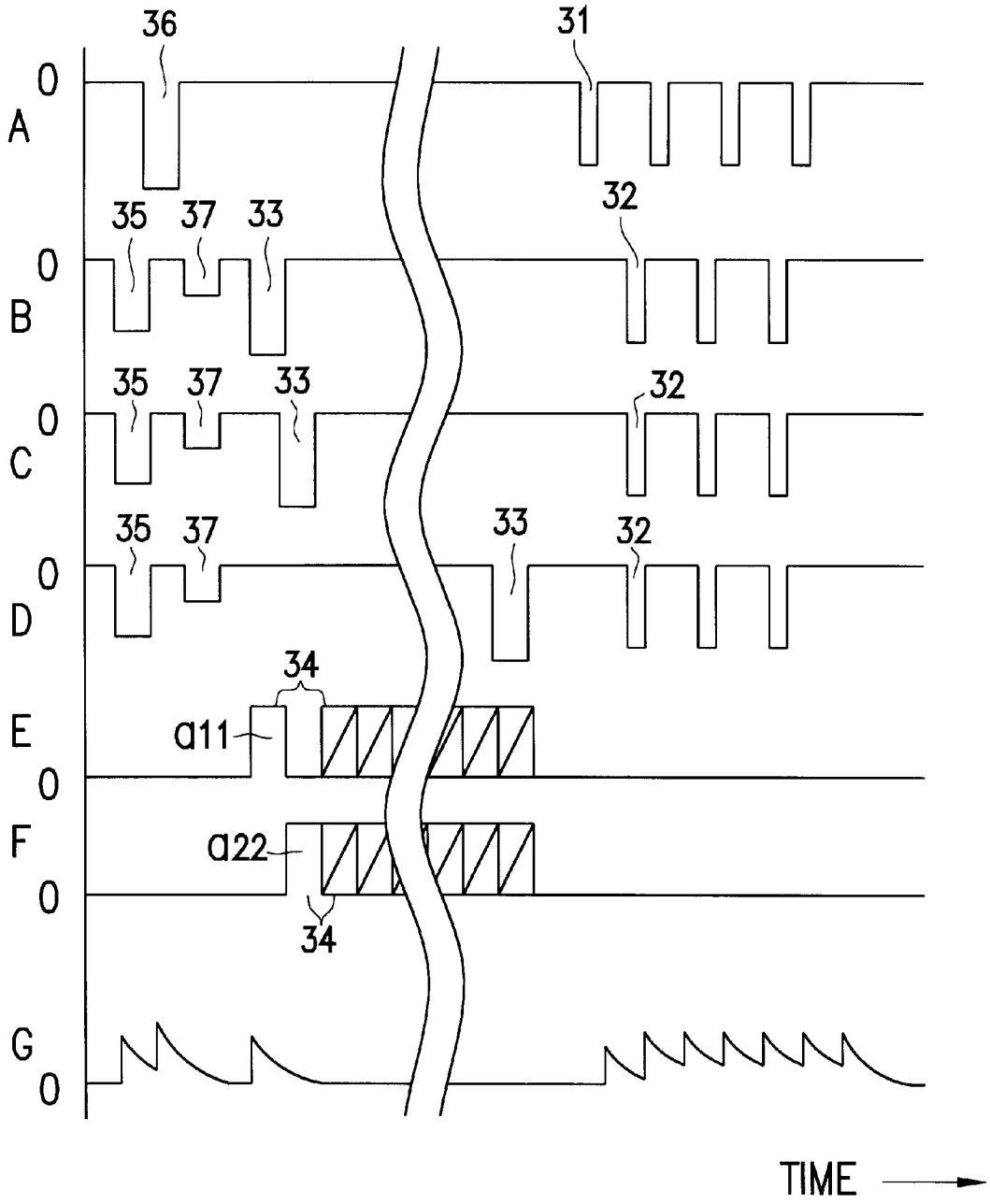
FIG. 4 PRIOR ART
FIG. 4 is a diagram showing the waveforms of drive voltages in one of the subfields shown in FIG. 3.
Figure 5:
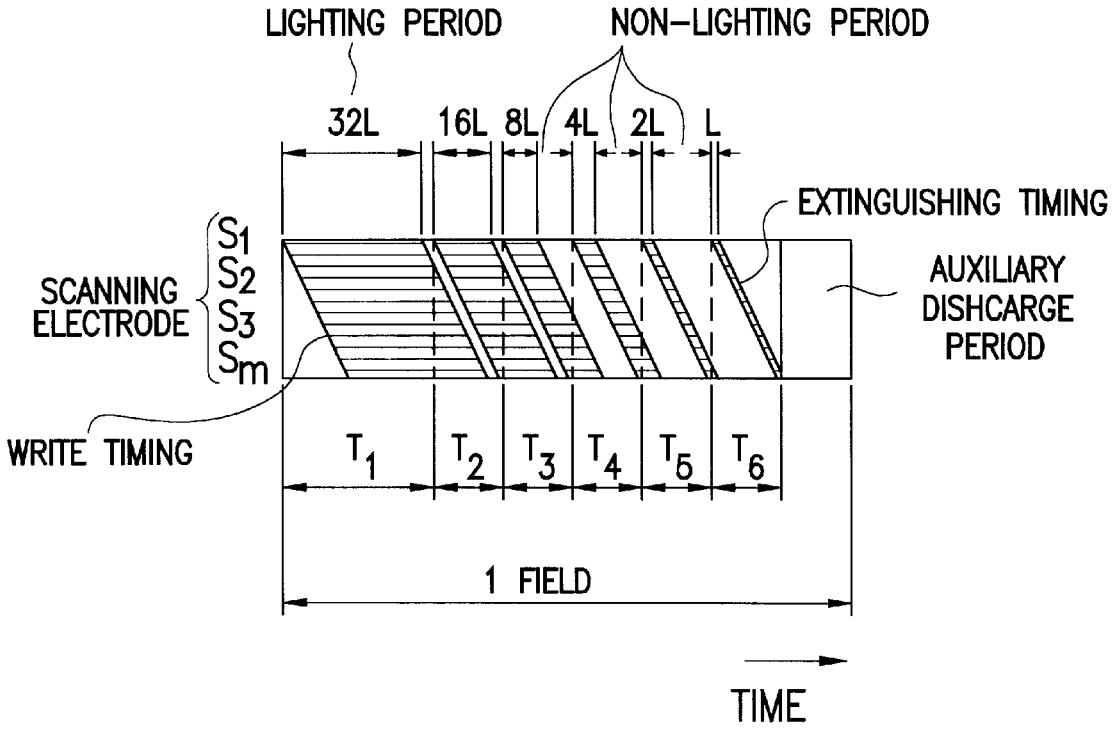
FIG. 5 PRIOR ART
FIG. 5 is a diagram illustrating subfields with mixed scanning and sustaining discharges.
Figure 6:
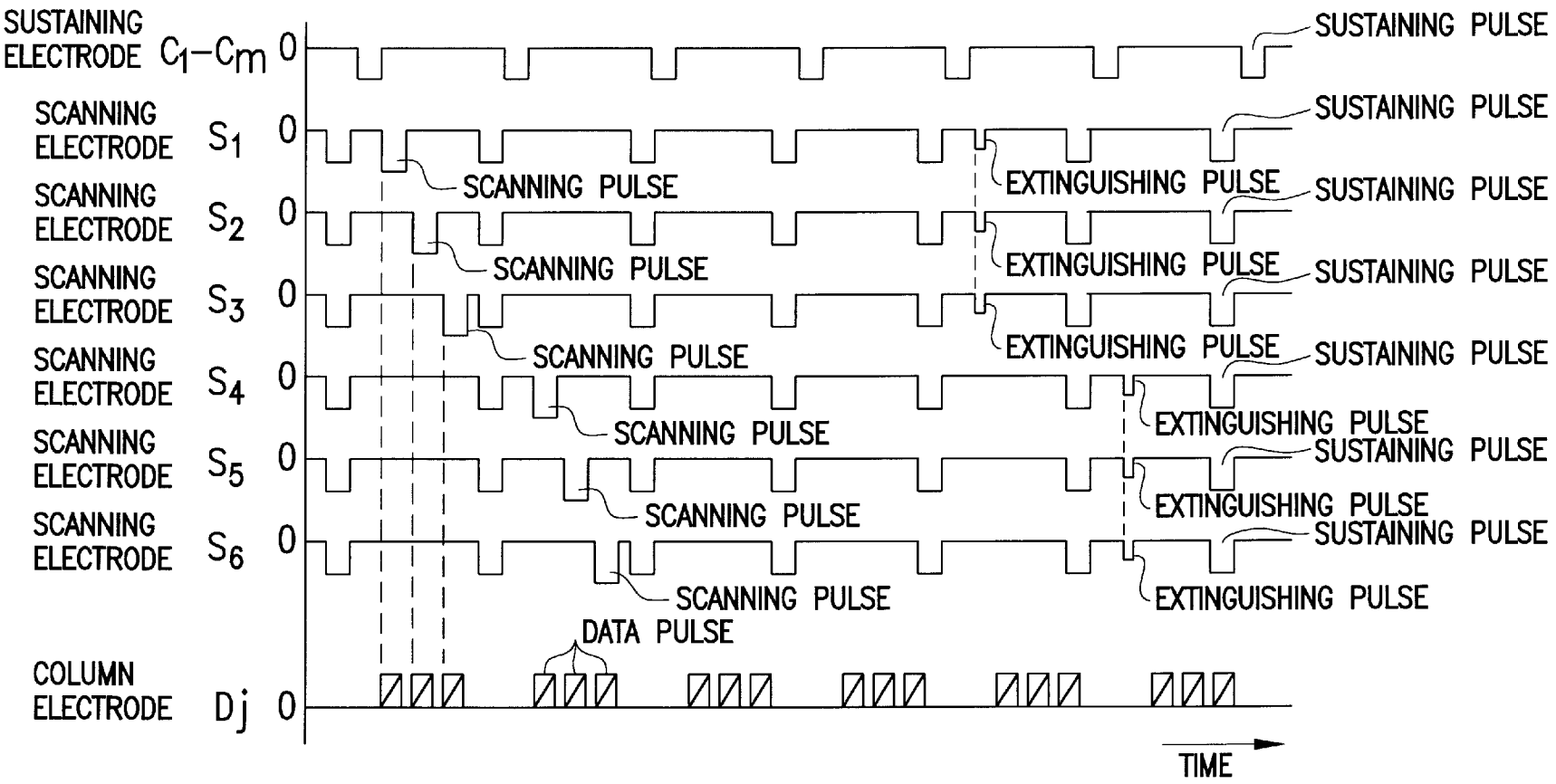
FIG. 6 PRIOR ART
FIG. 6 is a diagram showing the waveforms of drive voltages in one of the subfields shown in FIG. 5.
Figure 7:
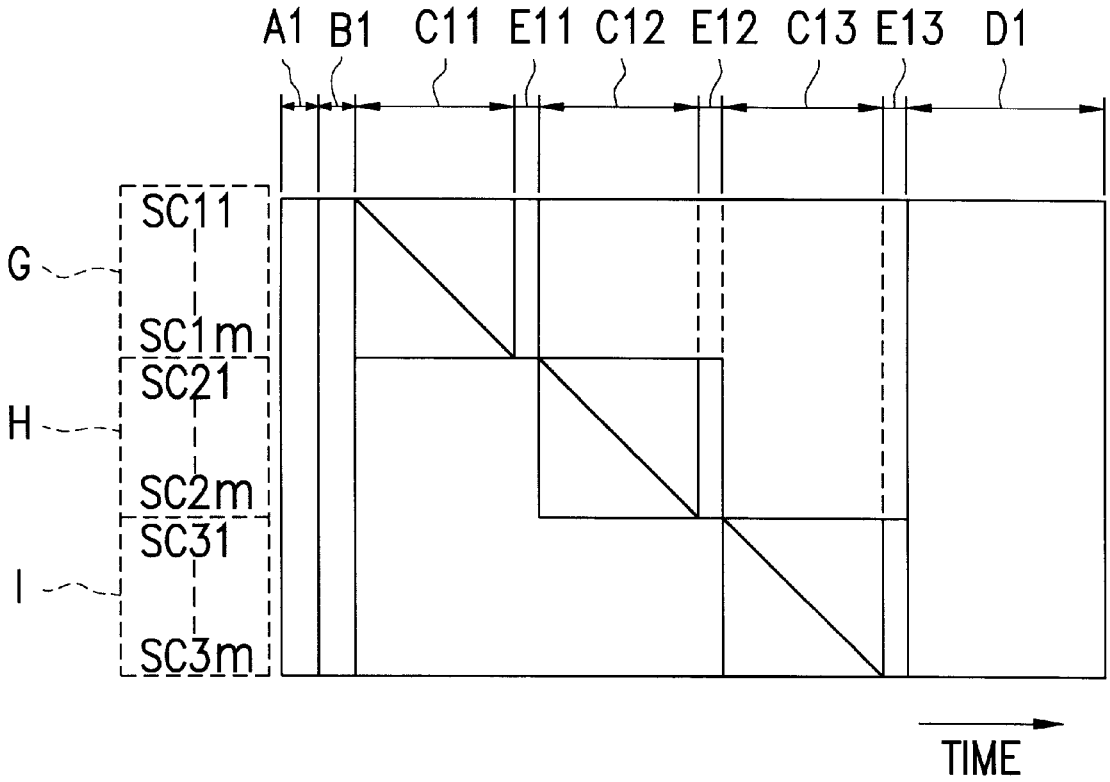
FIG. 7 PRIOR ART
FIG. 7 is a diagram illustrative of a driving process for a subfield with scanning electrodes and sustaining electrodes being divided into scanning electrode blocks and sustaining electrode blocks, and the time from writing discharges until sustaining discharges being shortened.
Figure 8:
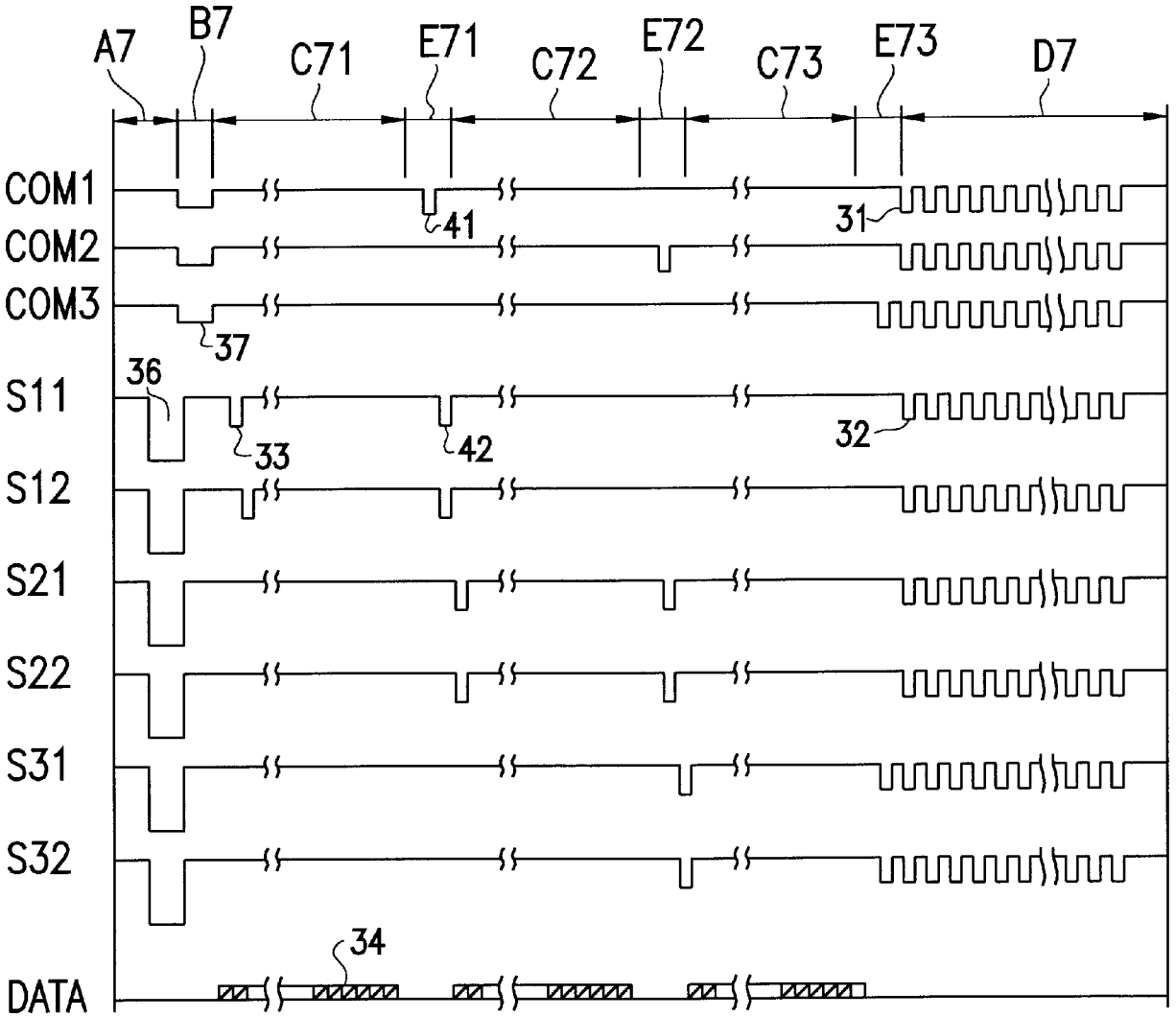
FIG. 8 PRIOR ART
FIG. 8 is a diagram showing the waveforms of drive voltages applied in the driving process shown in FIG. 7.
Figure 9:
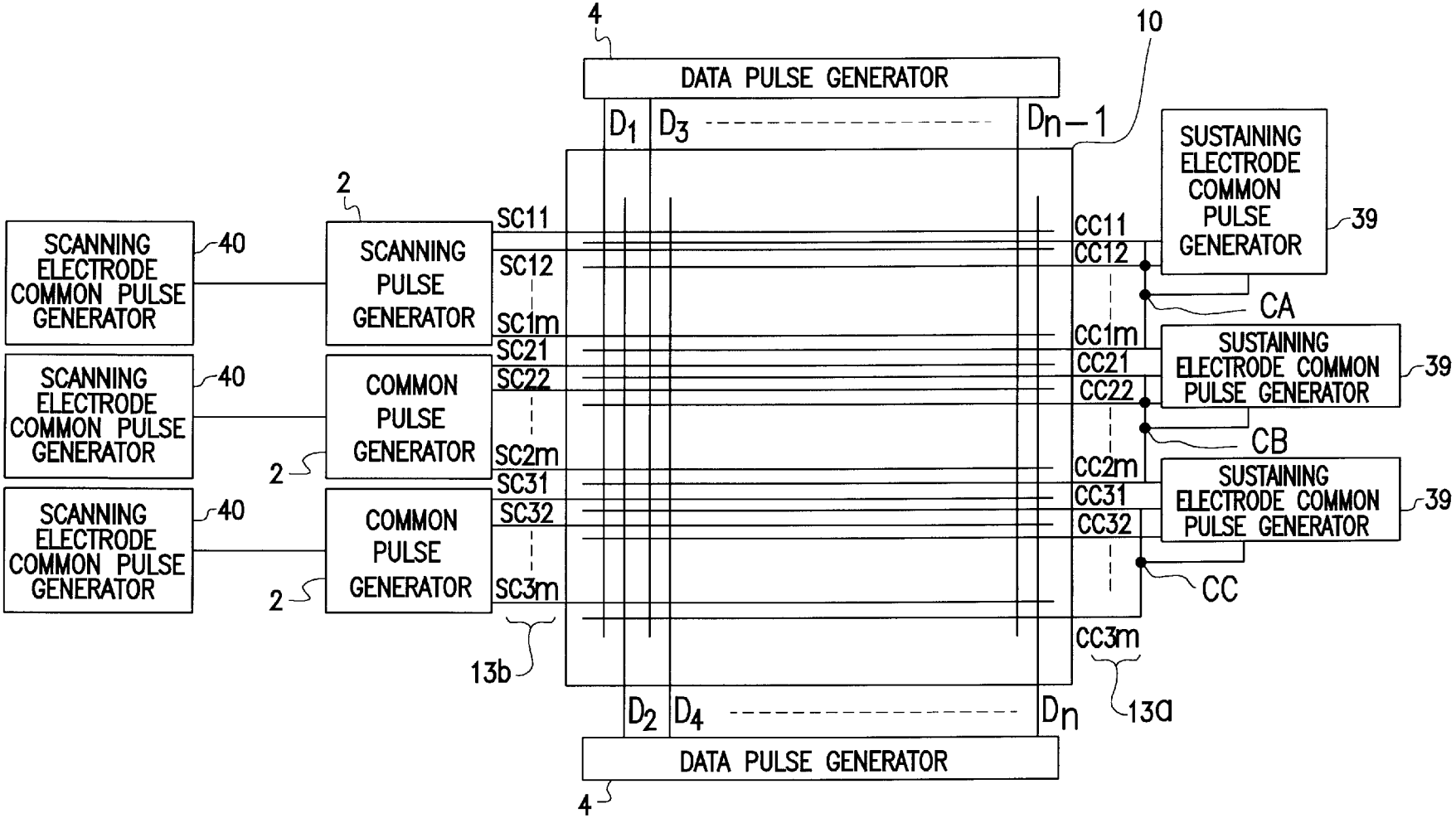
FIG. 9 PRIOR ART
FIG. 9 is a block diagram of a circuit arrangement for generating the drive voltages shown in FIG. 8.
Figure 10:
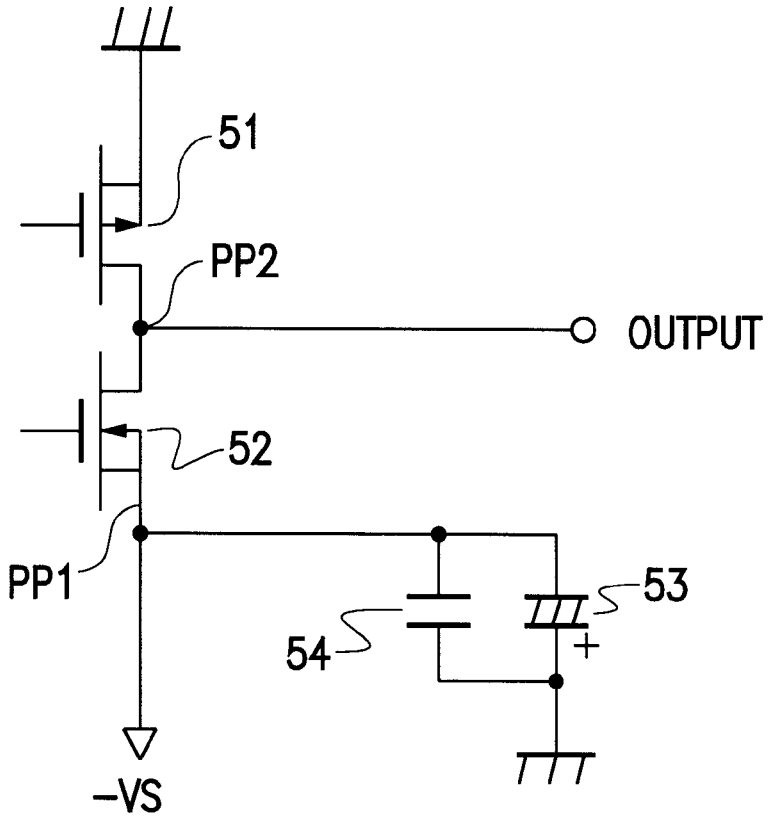
FIG. 10 PRIOR ART
FIG. 10 is a circuit diagram of a basic sustaining pulse generating circuit for the scanning electrode blocks or the sustaining electrode blocks.
Figure 11A:
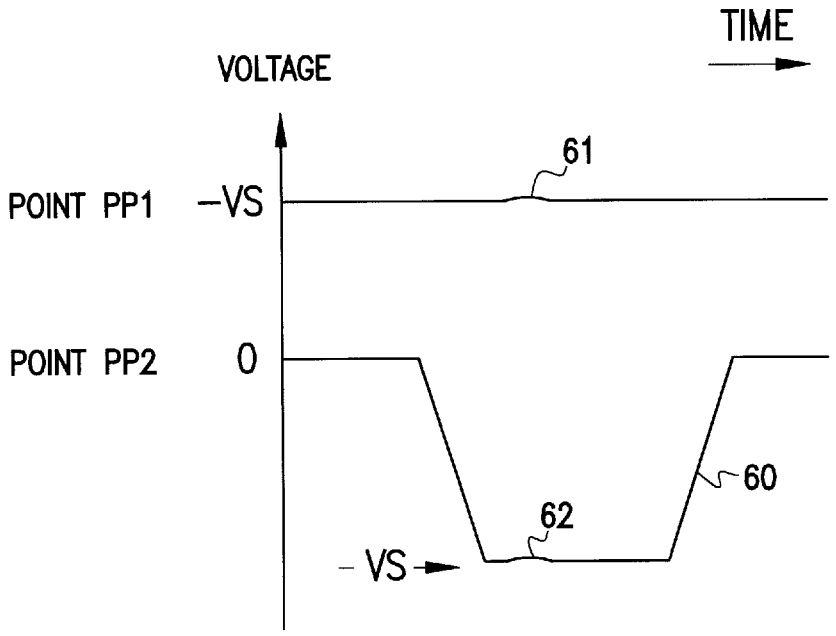
FIG. 11A PRIOR ART
FIG. 11A is a diagram showing the waveforms of voltages in the basic sustaining pulse generating circuit for the scanning electrode blocks or the sustaining electrode blocks where the number of light-emitting pixels is small.
Figure 11B:
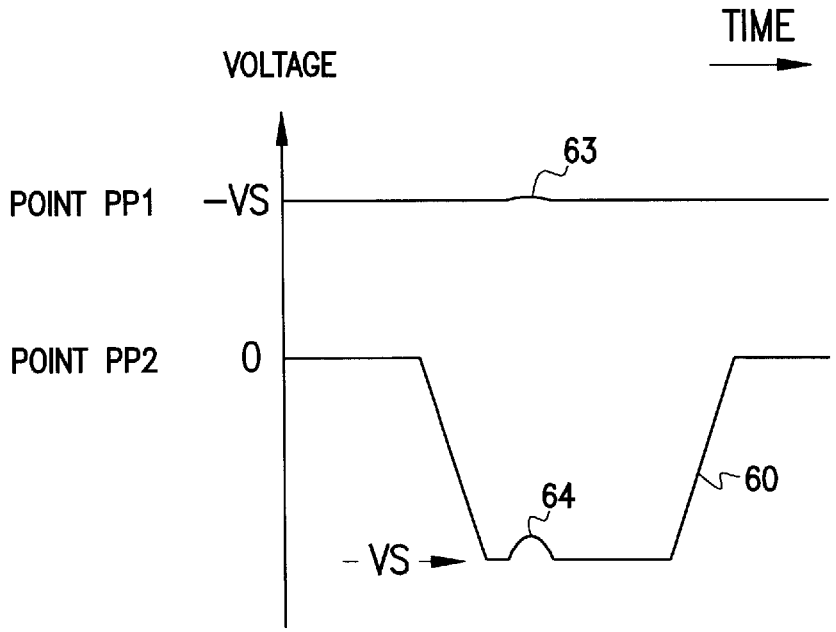
FIG. 11B PRIOR ART
FIG. 11B is a diagram showing the waveforms of voltages in the basic sustaining pulse generating circuit for the scanning electrode blocks or the sustaining electrode blocks where the number of light-emitting pixels is large.
Figure 14:
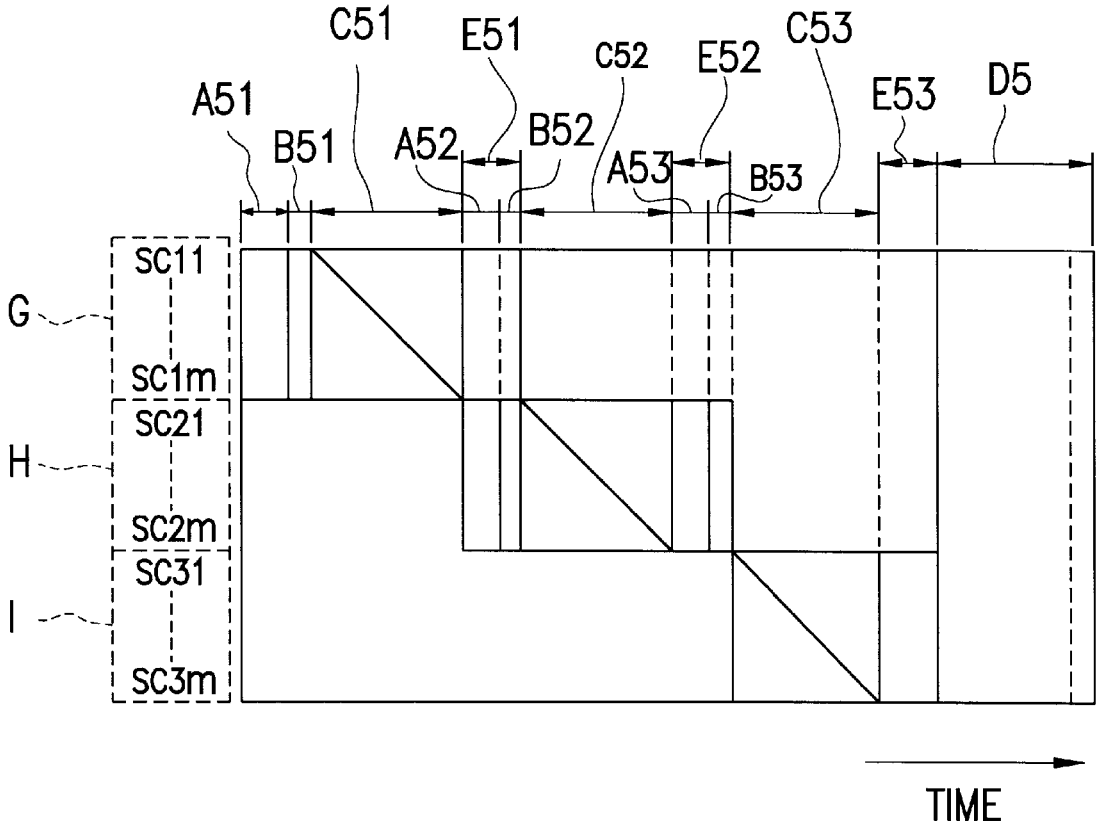
FIG. 14 is a diagram showing a driving sequence of the driver circuit shown in FIG. 12.

FIG. 14 shows a driving sequence of the driver circuit shown in FIG. 12. FIG. 14 illustrates a driving sequence in one subfield as with the driving sequence shown in FIG. 7 which is disclosed in Japanese laid-open patent publication No. 191627/95. In FIG. 14, the scanning electrodes are divided into three scanning electrode blocks G, H. I. Similarly, the sustaining electrodes paired with the scanning electrodes are also grouped into three sustaining electrode blocks corresponding to the scanning electrode blocks G, H, I.

In FIG. 14, A51, A52, A53 represent periods in which to apply independent preliminary discharge pulses to the scanning electrode blocks and the sustaining electrode blocks, B51, B52, B53 periods in which to apply independent preliminary discharge extinguishing pulses to the scanning electrode blocks and the sustaining electrode blocks, C51, C52, C53 writing discharge periods, E51, E52, E53 first sustaining discharge periods independent for the scanning electrode blocks and the sustaining electrode blocks, and D5 a second sustaining discharge period. The scanning electrodes SC11~SC3m are divided into three scanning electrode blocks G, H, I.

Preliminary discharge periods and preliminary discharge extinguishing periods, which are independent for the scanning electrode blocks and the sustaining electrode blocks, are provided in order to reduce the time from a preliminary discharge extinguishment to a writing discharge. The independent first sustaining discharge periods E51, E52, E53 , which are independent for the scanning electrode blocks and the sustaining electrode blocks, are provided immediately after writing operation in the scanning electrode blocks and the sustaining electrode blocks in order to reduce a writing discharge to a sustaining discharge.

Figure 15:
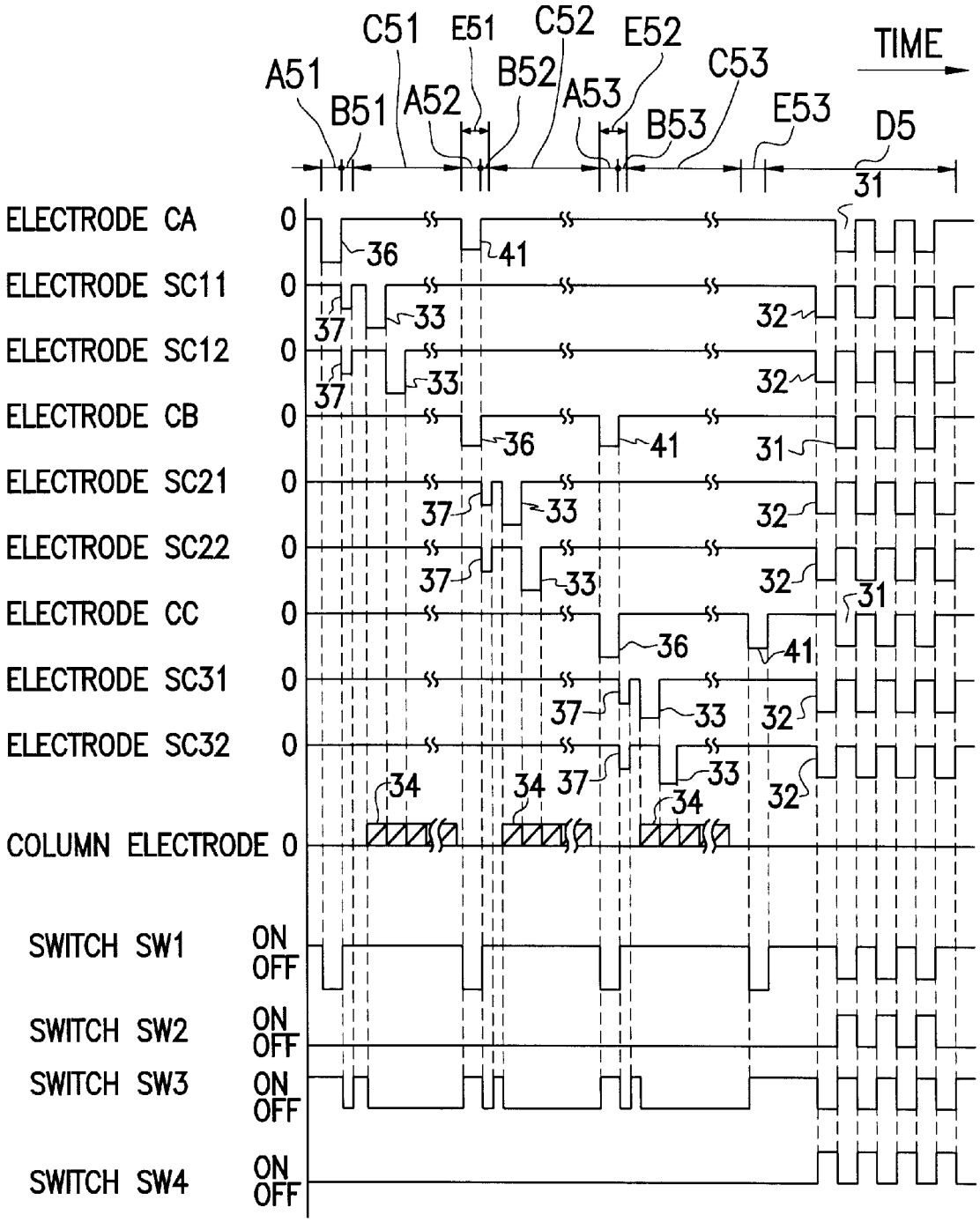
FIG. 15 is a diagram showing the waveforms of drive voltages and operation of switches in the driver circuit shown in FIG. 12.

FIG. 15 shows the waveforms of drive voltages and operation of switches in the driver circuit shown in FIG. 12. The waveforms shown in FIG. 15 correspond to the driving sequence shown in FIG. 7.

The sustaining pulses 31 have a pulse duration of 2 us, a period of 6 us, and a voltage of −160 V. The scanning pulses 32 have the same pulse duration, period, and voltage as those of the sustaining pulses 31. The scanning pulses 33 have a pulse duration of 3 us and a voltage of −180 V. The data pulses 34 have the same pulse duration as that of the scanning pulses 33, and a voltage of +70 V. The preliminary discharge pulses 36 have a pulse duration of 10 us and a voltage of −300 V. The preliminary discharge extinguishing pulses 37 have a pulse duration of 1 us and a voltage of −90 V. The sustaining pulses 41 have a pulse duration of 20 us and a voltage of −160 V. Extinguishing pulses are not employed in FIG. 15, but may be employed.

The preliminary discharge pulses 36, the sustaining pulses 41, and the sustaining pulses 31 are applied to the electrodes CA, CB, CC. Although not clearly understood from FIG. 15, the sustaining pulses 31 are applied commonly to the entire screen of the plasma display panel 10.

To the scanning electrodes SC11, SC12, . . . , SC1m, SC21, SC22, . . . , SC2m, and SC31, SC32, . . . , SC3m, there are applied linearly sequentially the sustaining pulses 32 common to these electrodes, the preliminary discharge extinguishing pulses 37 at independent times for the scanning electrode blocks and the sustaining electrode blocks, and the scanning pulses 33 at independent times for the scanning electrodes. The data pulses 34 are applied in synchronism with the scanning pulses 33.

Operation of the switches SW1~SW4 for generating sustaining pulses will be described below with reference to the waveforms shown in a lower portion of FIG. 15. In FIG. 12 which shows the driver circuit that operates according to the driving sequence shown in FIG. 14 with the drive voltages shown in FIG. 15 for applying the sustaining pulses 31 32 commonly to the entire screen of the plasma display panel 10, the switch SW1 is turned on connecting the electrodes CA, CB, CC to the ground potential in periods except while the preliminary discharge pulses 36, the sustaining pulses 41, and the sustaining pulses 31 are being applied, the switch SW2 is turned on holding the electrodes CA, CB, CC at a common sustaining pulse potential in periods while the sustaining pulses 31 are being applied, the switch SW3 is turned on connecting the scanning electrodes SC11, SCl2, . . . , SC1m, SC21, SC22, . . . , SC2m, and SC31, SC32, . . . , SC3m to the ground potential in periods except while the preliminary discharge extinguishing pulses 37, the scanning pulses 33, and the sustaining pulses 32 are being generated, and the switch SW4 is turned on holding the scanning electrodes at the common sustaining pulse potential in periods while the sustaining pulses 32 are being generated.

According to this embodiment, since only sustaining pulses for displaying images with light emissions are applied commonly to the entire screen of the plasma display panel through the diodes, luminance differences which have heretofore been caused between the scanning electrode blocks and the sustaining electrode blocks that have been introduced for making writing operation reliable can fully be eliminated at an appreciably low cost.

The advantage results in a great improvement as compared with a highly costly approach that employs FETs as switches whose resistance is reduced in an attempt to suppress luminance irregularities between the scanning electrode blocks and the sustaining electrode blocks. Even such low-resistance FETs are unable in principle to completely eliminate luminance irregularities between the scanning electrode blocks and the sustaining electrode blocks. According to the present embodiment, since the switches for generating the sustaining pulses are shared over the entire screen of the plasma display panel, no luminance differences are developed in principle over the entire screen of the plasma display panel, which is thus capable of displaying high-quality images.

Figure 16:
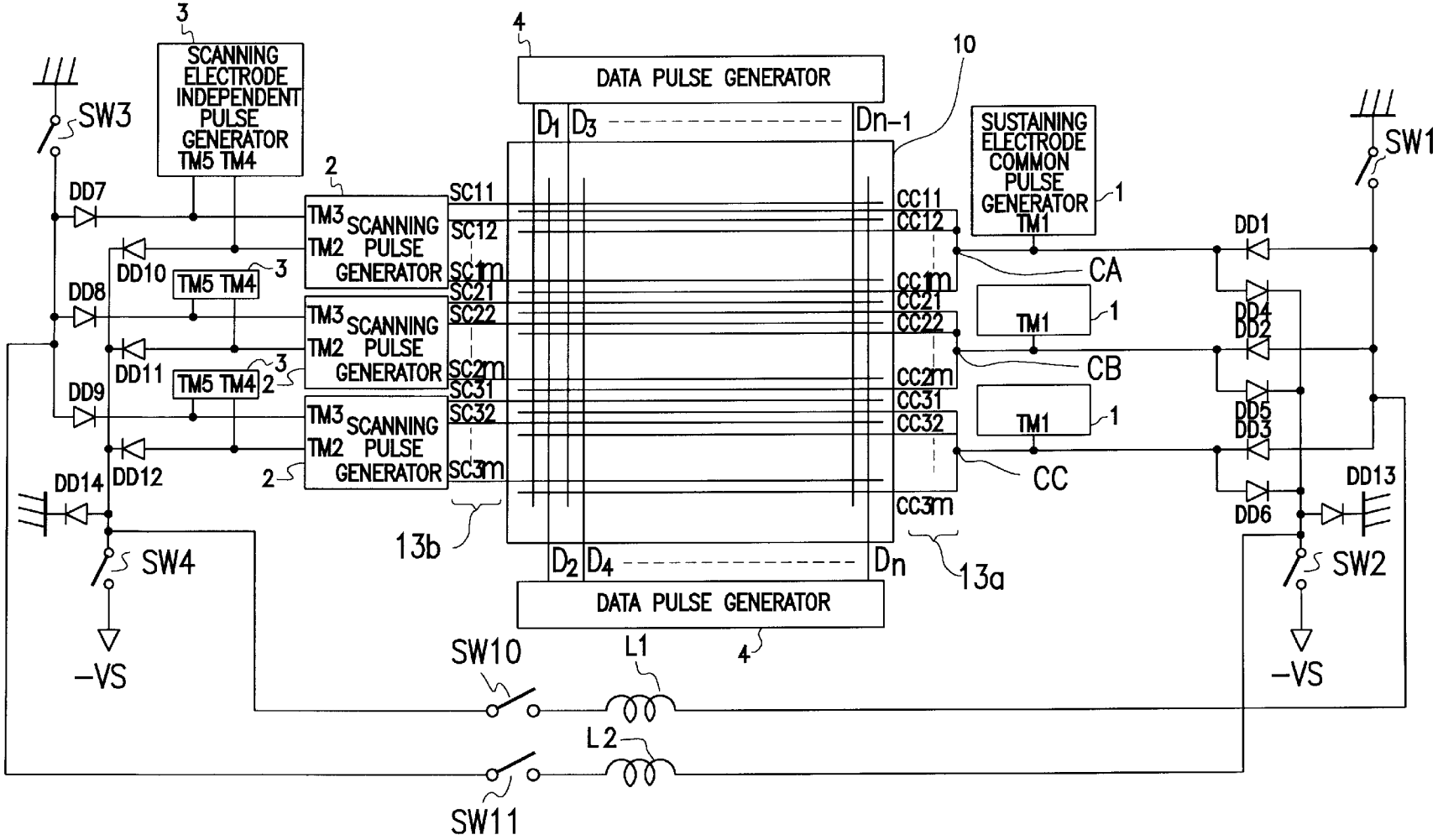
FIG. 16 is a block diagram of a driver circuit for a plasma display panel according to a second embodiment of the present invention.

FIG. 16 shows a driver circuit for a plasma display panel according to a second embodiment of the present invention, which includes a pair of charge collecting circuits. The plasma display panel according to the second embodiment employs charge collecting circuits as disclosed in Japanese patent application No. 41536/95 for collecting energy to charge and discharge the static capacity of the plasma display panel for thereby effectively reducing its power requirement. Those parts shown in FIG. 16 which are identical to those shown in FIG. 12 are denoted by identical reference characters and will not be described in detail below.

As shown in FIG. 16, the driver circuit additionally has a switch SW10 having an end connected to the cathodes of the diodes DD10~DD12 and an opposite end to an end of a charge-collecting coil L1 whose opposite end is connected to the anodes of the diodes DD1~DD3, and a switch SW11 having an end connected to the anodes of the diodes DD7~DD9 and an opposite end to an end of a charge-collecting coil L2 whose opposite end is connected to the cathodes of the diodes DD~DD6. The switch SW10 and the coil L1 jointly make up a charge collecting circuit, and the switch SW11 and the coil L2 also jointly make up a charge collecting circuit. Other details of the driver circuit shown in FIG. 16 are the same as those of the driver circuit shown in FIG. 12.

Figure 17:
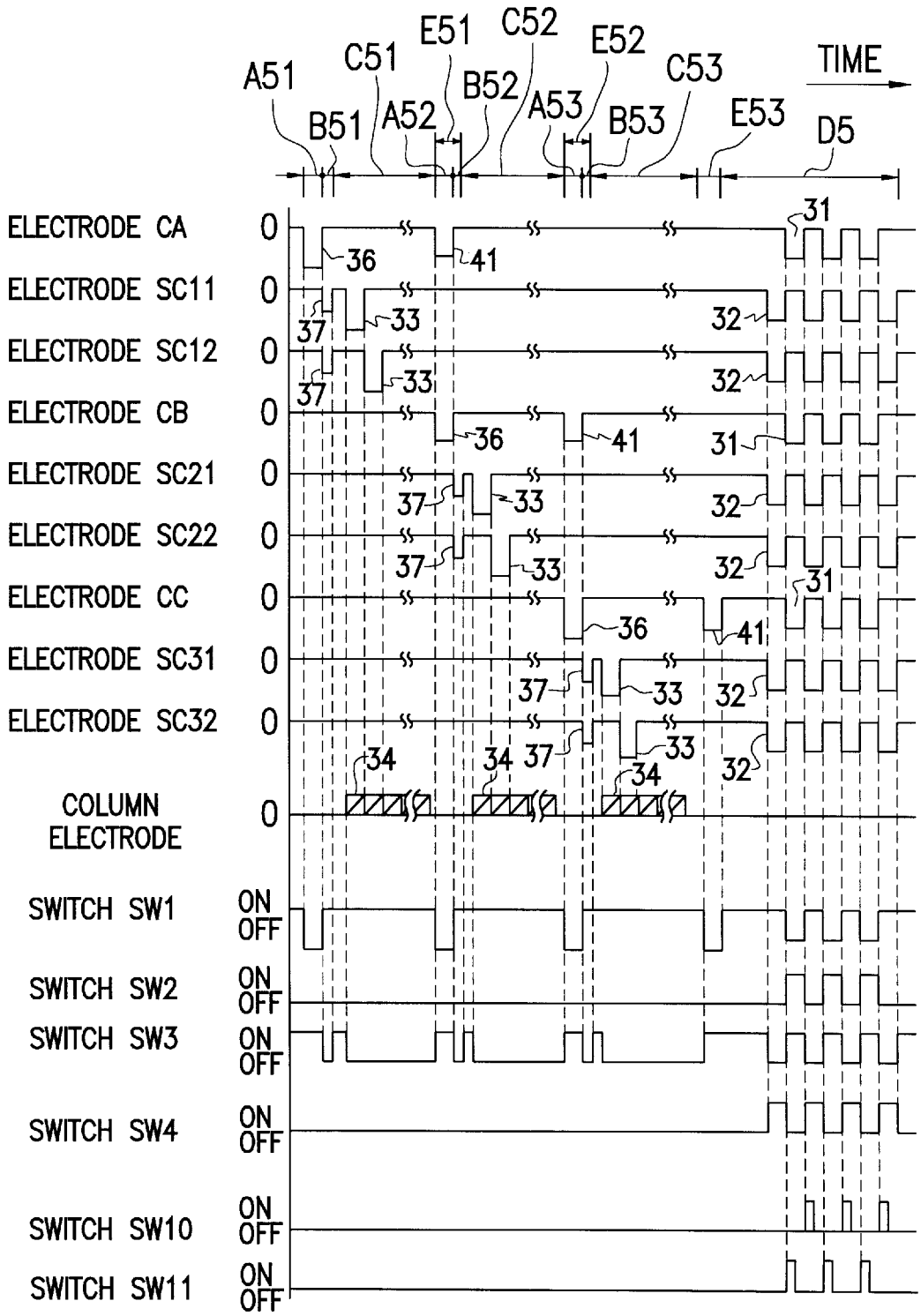
FIG. 17 is a diagram showing the waveforms of drive voltages and operation of switches in the driver circuit shown in FIG. 16.

The waveforms of drive voltages and operation of the switches of the driver circuit shown in FIG. 16 will be described below with reference to FIG. 17. The drive voltages and operation of the switches SW1~SW4 shown in FIG. 17 are the same as those shown in FIG. 15. The switch SW11 is turned on at a positive-going edge of the first sustaining pulse 32, and successively turned on at respective positive-going edges of the successive sustaining pulses 32. At the final sustaining pulse 32, the switch SW10 remains turned off as the sustaining pulses are stopped.

The switch SW10 is turned on at a positive-going edge of the first sustaining pulse 31, and successively turned on at respective positive-going edges of the successive sustaining pulses 31. At the final sustaining pulse 31, the sustaining pulses are not yet stopped, but lead to the final sustaining pulse 32. The switch SW10 is turned on at a positive-going edge of the final sustaining pulse 31.

Figure 18:
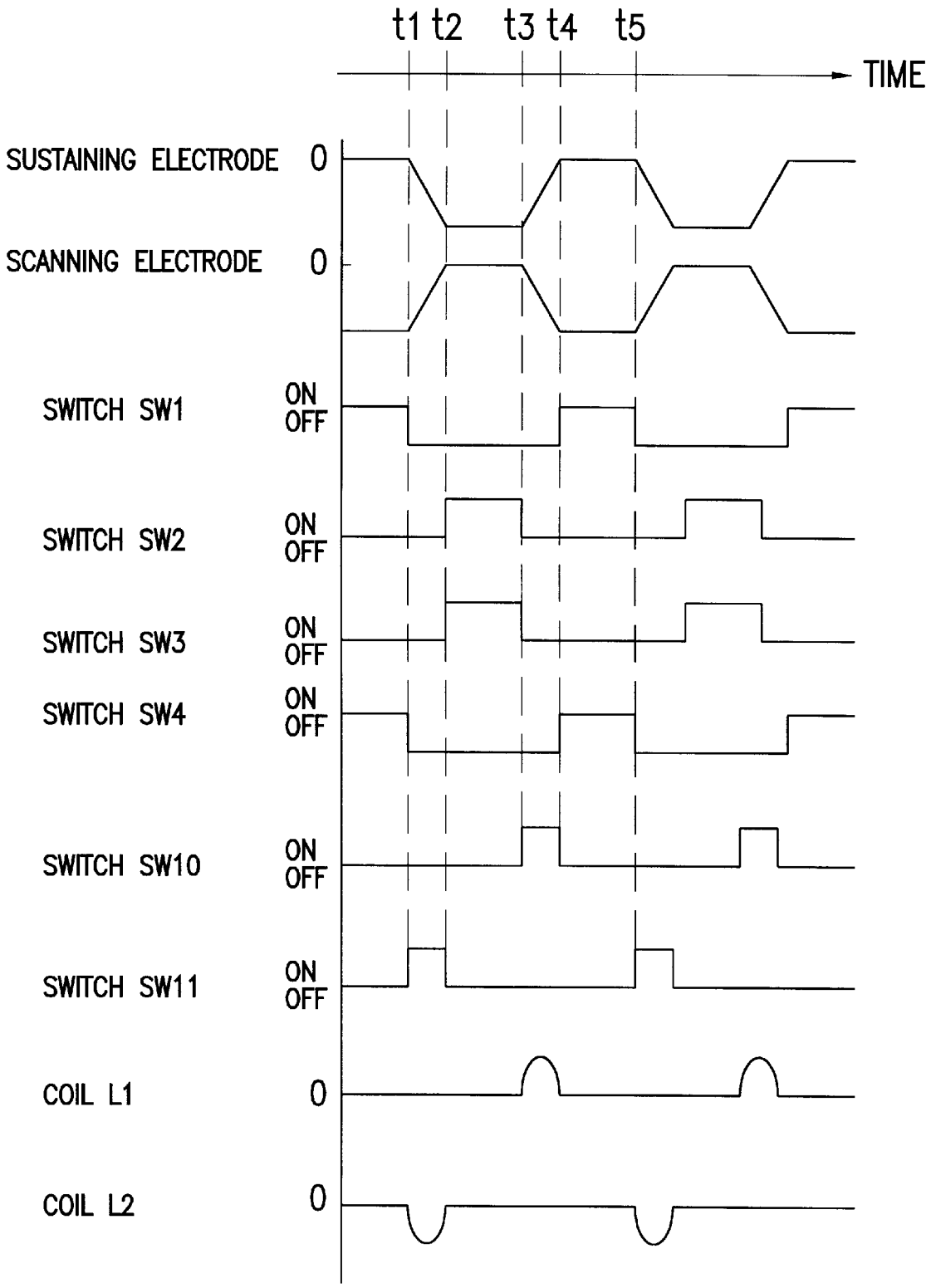
FIG. 18 is a diagram showing at enlarged scale a portion of the waveforms of drive voltages and operation of switches shown in FIG. 17 and also the waveforms of currents flowing through coils.

Finally, the operational relationship of the switches SW1~SW4, the switch SW10, the switch SW11 will be described below with reference to FIG. 18. FIG. 18 shows at enlarged scale a portion of the waveforms shown in FIG. 17 where sustaining pulses are successively generated in the period D5. FIG. 18 also shows the waveforms of currents flowing through the coils L1, L2, the currents being positive when flowing in the direction indicated by the arrows in FIG. 16.

In the range shown in FIG. 18, the sustaining electrodes 13*a* are kept at a zero potential and the scanning electrodes 13*b* are kept at a negative sustaining pulse potential prior to a time t1.

At the time t1, the switches SW1, SW4 are turned off, and only the switch SW11 is turned on. A current now flows from the sustaining electrodes 13*a* through the diodes DD4~DD6, the coil L2, the switch SW11, the diodes DD7~DD9, and the terminals TM3 of the scanning pulse generators 2 to the scanning electrodes 13*b*, charging the sustaining electrodes 13*a* and the scanning electrodes 13*b* to an opposite polarity. The current flows due to resonance between the coil L2 and the static capacity of the plasma display panel 10.

As a result, the potential of the sustaining electrodes 13*a* decreases, and the potential of the scanning electrodes 13*b* increases. At a time t2 when the resonant current flowing through the coil L2 stops, the switch SW11 is turned off, and the switches SW2, SW3 are turned on, whereupon the sustaining electrodes 13*a* are connected to the negative sustaining pulse potential and the scanning electrodes 13*b* are connected to the zero potential.

At a time t3, the switches SW2, SW3 are turned off, and only the switch SW10 is turned on. A resonant current now flows from the scanning electrodes 13*b* through the terminals TM2 of the scanning pulse generators 2, the diodes DD11~DD12, the switch SW10, the coil L1, and the diodes DD1~DD3 to the sustaining electrodes 13*a*, charging the sustaining electrodes 13*a* and the scanning electrodes 13*b* to an opposite polarity.

As a result, the potential of the sustaining electrodes 13*a* increases, and the potential of the scanning electrodes 13*b* decreases. At a time t4 when the resonant current flowing through the coil L1 stops, the switch SW10 is turned off, and the switches SW1, SW4 are turned on, whereupon the sustaining electrodes 13*a* are connected to the zero potential and the scanning electrodes 13*b* are connected to a sustaining pulse potential.

The above operation after the time t1 is repeated after a time t5.

As described above, the added charge collecting circuit effectively collects energy to charge and discharge the static capacity of the plasma display panel for thereby saving electric power to operate the plasma display panel.

The switch SW11 has been described as being turned off at the time t2 when the resonant current falls to zero. Actually, however, since the resonant current tending to flow continuously through the coil L2 after the time t2 is blocked by the diodes DD4~DD6 or the diodes DD7~DD9, the switch SW11 may be turned off anytime between the times t2, t3. Likewise, the switch SW10 may be turned off anytime between the times t4, t5.

The switching elements used in the drive circuits according to the above embodiments may comprise a field-effect transistor (FET) which can turn on and off a large current at a high speed, and also a bipolar transistor, a thyristor, an IGBT, or the like insofar as it has an appropriate operation speed and a current supply capability.

The principles of the present invention are applicable to a plasma display panel free of sustaining electrodes, i.e., a facing-discharge-type plasma display panel.

While preferred embodiments of the present invention have been described using specific terms, such description is for illustrative purposes only, and it is to be understood that changes and variations may be made without departing from the spirit or scope of the following claims.

What is claimed is:

1. A driver circuit for a plasma display panel having striped scanning electrodes and striped column electrodes perpendicular to the striped scanning electrodes, said scanning electrodes being divided into a plurality of scanning electrode blocks, and also having a preliminary discharge period and a writing period for each of said scanning electrode blocks, and a sustaining period common to all of said scanning electrodes, said driver circuit comprising:

a data pulse generator for generating data pulses;

a plurality of scanning pulse generators associated with said scanning electrode blocks, respectively, for generating scanning pulses;

a first switch comprising a pull-up switch for generating sustaining pulses to be applied to the plasma display panel in said sustaining period, said first switch having one end connected to a higher potential side of a sustaining pulse power supply and the opposite end for supplying a current to the plasma display panel;

a first group of as many diodes as the number of said scanning electrode blocks, said diodes of the first group having respective anodes connected in common to the opposite end of said first switch and respective cathodes connected respectively to said scanning pulse generators;

a second switch comprising a pull-down switch for generating sustaining pulses to be applied to the plasma display panel in said sustaining period, said second switch having one end connected to a lower potential side of the sustaining pulse power supply and the opposite end for drawing a current from the plasma display panel;

a second group of as many diodes as the number of said scanning electrode blocks, said diodes of the second group having respective cathodes connected in common to the opposite end of said second switch and respective anodes connected respectively to said scanning pulse generators; and third switches associated respectively with said scanning electrode blocks for generating pulses other than said sustaining pulses independently with respect to said scanning electrode blocks.

2. A driver circuit for a plasma display panel having striped scanning electrodes, striped sustaining electrodes paired with said scanning electrodes and extending parallel to said scanning electrodes, striped column electrodes perpendicular to said scanning electrodes and said sustaining electrodes, said scanning electrodes being divided into a plurality of scanning electrode blocks and said sustaining electrodes being divided into a plurality of sustaining electrode blocks paired with said scanning electrode blocks, and also having a preliminary discharge period and a writing period for each of said scanning electrode blocks and said sustaining electrode blocks, and a sustaining period common to all of said scanning electrodes and said sustaining electrodes, said driver circuit comprising:

a data pulse generator for generating data pulses;

a plurality of scanning pulse generators associated with said scanning electrode blocks, respectively, for generating scanning pulses;

a first switch comprising a pull-up switch for generating sustaining pulses with respect to the scanning electrodes to be applied to the plasma display panel in said sustaining period, said first switch having one end connected to a higher potential side of a sustaining pulse power supply and the opposite end for supplying a current to the plasma display panel;

a first group of as many diodes as the number of said scanning electrode blocks, said diodes of the first group having respective anodes connected in common to the opposite end of said first switch and respective cathodes connected respectively to said scanning pulse generators;

a second switch comprising a pull-down switch for generating sustaining pulses with respect to the scanning electrodes to be applied to the plasma display panel in said sustaining period, said second switch having one end connected to a lower potential side of the sustaining pulse power supply and the opposite end for drawing a current from the plasma display panel;

a second group of as many diodes as the number of said scanning electrode blocks, said diodes of the second group having respective cathodes connected in common to the opposite end of said second switch and respective anodes connected respectively to said scanning pulse generators;

a third switch comprising a pull-up switch for generating sustaining pulses with respect to the sustaining electrodes to be applied to the plasma display panel in said sustaining period, said third switch having one end connected to the higher potential side of the sustaining pulse power supply and the opposite end for supplying a current to the plasma display panel;

a third group of as many diodes as the number of said sustaining electrode blocks, said diodes of the third group having respective anodes connected in common to the opposite end of said third switch and respective cathodes connected respectively to said sustaining electrode blocks;

a fourth switch comprising a pull-down switch for generating sustaining pulses with respect to the sustaining electrodes to be applied to the plasma display panel in said sustaining period, said fourth switch having one end connected to the lower potential side of the sustaining pulse power supply and the opposite end for drawing a current from the plasma display panel;

a fourth group of as many diodes as the number of said sustaining electrode blocks, said diodes of the fourth group having respective cathodes connected in common to the opposite end of said fourth switch and respective anodes connected respectively to said sustaining electrode blocks;

fifth switches associated respectively with said scanning electrode blocks for generating pulses other than said sustaining pulses independently with respect to said scanning electrode blocks; and sixth switches associated respectively with said sustaining electrode blocks for generating pulses other than said sustaining pulses independently with respect to said sustaining electrode blocks.

3. A driver circuit according to claim 2, further comprising a first charge collecting circuit interconnecting said first switch and said fourth switch, and a second charge collecting circuit interconnecting said second switch and said third switch.

4. A driver circuit according to claim 3, wherein each of said first and second charge collecting circuits comprises a switch which can be turned on in response to a positive-going edge of one of the sustaining pulses and a coil connected to said switch.

* * * * *